US005330873A

United States Patent [19]

Doi et al.

[11] Patent Number: 5,330,873

[45] Date of Patent: Jul. 19, 1994

[54] PRODUCTION METHOD OF PHOTOSENSITIVE MEMBER BY ELIMINATING OUTERMOST SURFACE PORTION OF PHOTOSENSITIVE LAYER

[75] Inventors: Isao Doi, Toyonaka; Kenji Masaki, Ibaraki; Shuji Iino, Hirakata; Izumi Osawa, Ikeda, all of Japan

[73] Assignee: Minolta Camera Kabushiki Kaisha, Osaka, Japan

[21] Appl. No.: 4,675

[22] Filed: Jan. 14, 1993

Related U.S. Application Data

[63] Continuation of Ser. No. 611,710, Nov. 9, 1990.

[30] Foreign Application Priority Data

| | | | |
|---|---|---|---|
| Nov. 9, 1989 | [JP] | Japan | 1-291859 |
| Nov. 9, 1989 | [JP] | Japan | 1-291860 |
| Nov. 9, 1989 | [JP] | Japan | 1-291861 |
| Nov. 9, 1989 | [JP] | Japan | 1-291862 |
| Nov. 30, 1989 | [JP] | Japan | 1-312960 |

[51] Int. Cl.[5] ..... G03G 5/00

[52] U.S. Cl. ..... 430/133; 430/127; 430/128

[58] Field of Search ..... 430/127, 128, 133

[56] References Cited

U.S. PATENT DOCUMENTS

| | | | |
|---|---|---|---|
| 4,687,723 | 8/1987 | Ohshima et al. | 430/65 |
| 4,755,444 | 7/1988 | Karakida et al. | 430/66 |
| 4,882,256 | 11/1989 | Osawa et al. | 430/66 |
| 4,886,724 | 12/1989 | Masaki et al. | 430/66 |
| 4,891,291 | 1/1990 | Masaki et al. | 430/66 |
| 4,891,292 | 1/1990 | Masaki et al. | 430/66 |
| 4,933,247 | 6/1990 | Osawa et al. | 430/128 |
| 5,030,536 | 7/1991 | Pai et al. | 430/127 |

*Primary Examiner*—Steve Rosasco

*Attorney, Agent, or Firm*—Burns, Doane, Swecker & Mathis

[57] ABSTRACT

This invention relate to a production method of a photosensitive member having an organic photosensitive layer and a surface protective layer in this order on an electrically conductive substrate comprising;

a first step of forming the organic photosensitive layer on the electrically conductive substrate, a second step of eliminating an outermost surface portion of the organic photosensitive layer, and a third step of forming the surface protective layer under vacuum conditions on the organic photosensitive layer.

13 Claims, 5 Drawing Sheets

PRODUCTION METHOD OF PHOTOSENSITIVE MEMBER BY ELIMINATING OUTERMOST SURFACE PORTION OF PHOTOSENSITIVE LAYER

This application is a continuation of application Ser. No. 07/611,710, filed Nov. 9, 1990, now abandoned.

BACKGROUND OF THE INVENTION

This invention relates to a production method of a photosensitive member having a surface protective layer.

Organic photosensitive members are well known. The organic photosensitive member is excellent in sensitivity and chargeability, and costs low for its production.

However, the organic photosensitive members have problems. For example, the surface of organic photosensitive layer is soft. The organic photosensitive member is worn, liable to be injured, and comes to form image-defects and white lines when repeatedly used. The reduction of thickness of the photosensitive member also causes the fall-off of surface potential.

Therefore, a surface protective layer is generally formed on the photosensitive layer in order to overcome the above mentioned problems.

It is desirable that the surface protective layer is formed immediately after the photosensitive layer is formed. But, a number of photosensitive layers are once formed on electrically conductive substrates because of simplification of production and from the view points of a production equipments. And then, surface protective layers, such as amorphous carbon layers or the like, are formed on the photosensitive layers. In general, the photosensitive layers are kept for a few days—a few months until the surface protective layers are formed (this keeping period is referred to as "stock time in process").

The surface of an organic photosensitive layer is oxidized with time by oxygen in the air. When a surface protective layer, such as an amorphous carbon layer, is formed on the organic photosensitive layer, the surface of which is oxidized, the surface protective layer separates off because the adhesivity of the protective layer to the oxidized layer is poor. After only one day passed from the preparation of an organic photosensitive layer, the surface of the organic photosensitive layer is already oxidized to such degree that the surface protective layer is liable to separate off.

By the way, photosensitive members having surface-protective thin layers deposited under vacuum conditions have been known well. But, there is no reference that discloses that a photosensitive layer should be surface-treated in order to secure adhesivity before a thin layer is deposited under vacuum conditions on the photosensitive layer kept for a long time.

SUMMARY OF THE INVENTION

Figure 1:
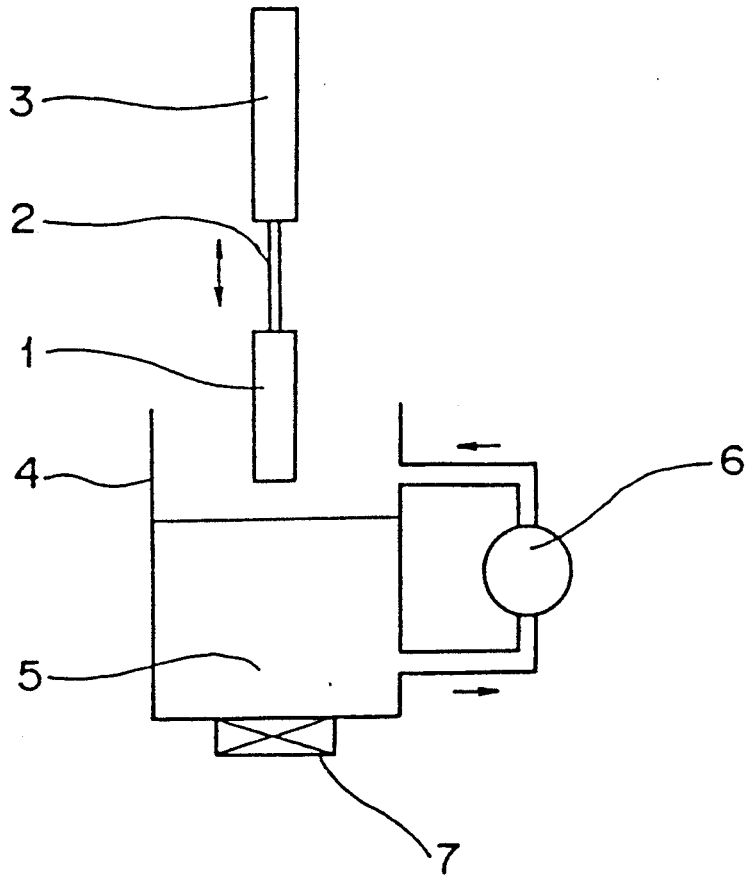
FIG. 1 shows a schematic view of a washing equipment.

The object of the invention is to provide a production method of a photosensitive member excellent in adhesivity of a surface protective layer to an organic photosensitive layer.

Another object of the present invention is to provide a production method of a photosensitive member without the fall-off of surface potential and the nonuniformity of surface potential.

DETAILED DESCRIPTION OF THE INVENTION

The present invention provides a production method of a photosensitive member having a thin layer deposited under vacuum conditions as a surface protective layer excellent in adhesivity. The photosensitive member prepared by the present invention does not cause the fall-off of surface potential and the nonuniformity of surface potential.

The present invention has accomplished the above objects by eliminating outermost surface portion of a photosensitive layer before a surface protective layer is formed.

The present invention provides a production method of a photosensitive member having an organic photosensitive layer and a surface protective layer in this order on an electrically conductive substrate comprising;

a first step of forming the organic photosensitive layer on the electrically conductive substrate, a second step of eliminating an outermost surface portion of the organic photosensitive layer, and a third step of forming the surface protective layer under vacuum conditions on the organic photosensitive layer.

The outermost surface portion of the organic photosensitive layer is eliminated by a washing treatment with a solvent which can dissolve the organic photosensitive layer, a mechanically wearing treatment, a bombarding treatment or the like.

First, the washing treatment is explained.

The solvent used in the washing treatment is not limitative so far as it can dissolve the photosensitive layer. Preferable solvent is a non-chlorinated solvent from the view point of preventing the fall-off of surface potential and the nonuniformity of surface potential.

The non-chlorinated solvent used in the present invention means the one consisting of molecules which do not contain chlorine atoms, for example, saturated hydrocarbons, such as n-hexane, cyclohexane, pentane, cyclopentane, heptane, octane, ligroin, petroleum ether, benzine, isohexane, neohexane, 1-hexene and the like, alcohols of hydrocarbons, such as methanol, ethanol, propanol, butyl alcohol, allyl alcohol, benzyl alcohol and the like, aromatic hydrocarbons, such as toluene, xylene, hemimellitene, pseudocumene, tetraline and the like, ketones, such as acetone, ethyl methyl ketone, cyclohexanone, methyl vinyl ketone and the like, ethers, such as diethyl ether, dimethyl ether and the like. Fluorine-containing alcohols, such as fluoroethanol, fluoropropanol, fluorobutanol, fluoropentanol, fluorohexanol, fluorobutanediol. Preferable solvents are n-hexane, isohexane, 5-fluoropropanol, 3-fluoropropanol and the like. 5-fluoropropanol includes all isomers thereof.

The washing method of photosensitive layers includes a dipping method, a shower method, a vapor method and the like. The washing conditions are adjusted depending on types of photosensitive members (monodispersion type,, function-divided type), kinds of resins, kinds of solvents and the like.

The preferable washing method is a dipping method. A photosensitive member is washed sufficiently by dipping it in hexane at 20° C. for about 60 seconds. Ultrasonic vibration, circulation (for purification) of solvent or the like is effective in the dipping method.

When the vapor method is applied to wash a photosensitive layer, it is preferable that the washing treatment is carried out under such conditions as shown by the following formula [I]below;

$$Kmin \times H(Tb-Ts) \leqq t \leqq Kmax \times H(Tb-Ts) \quad [I]$$

in which t is time to be left to stand in vapor phase [second],

H is heat capacity per unit area of surface of electrically conductive substrate [$J \cdot K^{-1} \cdot cm^{-2}$], Tb is boiling point of solvent [K], Ts is temperature of electrically conductive substrate measured before photosensitive layer is exposed to vapor phase [K], Kmin is proportionality factor, being 1 [$J^{-1} \cdot cm^2 \cdot sec$], and Kmax is proportionality factor, being 8 [$J^{-1} \cdot cm^2 \cdot sec$]

Then, the mechanically wearing treatment is applied.

When the mechanically wearing treatment is applied to the present invention, a specified degree of the surface of a photosensitive layer is worn. The wearing method is not limitative, but exemplified by means of wearing with felt, a blade, a brush and the like. Plural photosensitive members may be brought into contact with each other to be worn.

The wearing degree is 30 Å−2 μm, preferably 90 Å−1 μm. If the wearing degree is low, the adhesivity of a surface protective layer is not sufficiently achieved. If the wearing degree is high, the thickness of the photosensitive layer decreases, resulting in decrease of surface potential.

The third means to wear a photosensitive layer is a bombarding treatment. The bombarding treatment means that the surface of the photosensitive layer is made to bombarded with ions. The oxidized layer formed on the surface of the photosensitive layer is bombarded physically with ions to eliminate the oxidized layer. The fresh surface of the photosensitive layer which is not oxidized appears.

The ions used in the bombarding treatment are obtained from under plasma conditions of inert gases.

The bombarding treatment is carried out under adequately adjusted conditions, such as pressure, frequency, electric power and the like. The bombarding treatment can be achieved more effectively under such conditions as low pressure, low frequency and high electric power.

When the temperature of the substrate of the photosensitive layer is set high, atoms dissociate more easily from the surface. The bombarding treatment is more effective.

The longer, the bombarding treatment is, the more effective, the bombarding treatment is.

With respect to inert gases used in the bombarding treatment, He, Ar, $H_2$, $N_2$, $O_2$, $N_2O$ and the like, which do not react each other to form a layer, may be used.

In the bombarding treatment, the oxidized layer formed on the surface of a photosensitive layer is eliminated in general by physical bombardment with ions. When $O_2$ is used as inert gas, the oxidized surface may be also eliminated chemically. When the oxidized surface is bombarded with oxygen in plasma conditions, carbon atoms (C) and hydrogen atoms (H) which constitute the surface of the photosensitive layer react with the oxygen in plasma conditions to form $CO_2$, $H_2O$ in gas phase. In this case, the surface is bombarded more effectively.

Organic photosensitive layers used in the present invention are not particularly limitative so far as outermost surface layers of the photosensitive layers are constituted of the ones of dispersion types of resin. Both monolayer types and function-divided types are applicable to the photosensitive layer. A photosensitive layer of mono layer type is prepared by dispersing a charge generating material such as phthalocyanine pigments, azo pigments, perylene pigments and the like, and a charge transporting material, such as triphenyl methane compounds, triphenyl amine compounds, hydrazone compounds, styryl compounds, pyrazoline compounds, oxazole compounds, oxadiazole compounds and the like into a binder resin, such as polyesters, polyvinyl butyrals, polycarbonates, polyarylates, styrene-acrylic polymers and the like.

A photosensitive layer of function-divided type is prepared by dispersing a charge generating material and a charge transporting material into a different resin layer to separate charge generating function and charge transporting function. The laminating order of the two layers is not particularly limitative. On the other hand, there is a charge generating layer constituted of a charge generating material itself, for example, deposition layer of phthalocyanine, not containing a binder resin.

In this case, a charge transporting layer of resin type is formed on the charge generating layer.

After the outermost surface portions of a photosensitive layer is eliminated as above mentioned, a surface protective layer is formed on the surface of the photosensitive layer under vacuum conditions by use of, for example, a plasma CVD method, a light CVD method, a heat CVD method, a sputtering method, a deposition method, an ion-plating method and the like.

The obtained surface protective layer is excellent in adhesivity to the photosensitive layer.

The resultant photosensitive member according to the present invention does not bring about fall-off of surface potential, nonuniformity of surface potential and the like.

The present invention is explained by concrete examples hereinafter.

EXAMPLES

Preparation of organic photosensitive layers (a)-(g)

Photosensitive layers (a)-(g) were prepared as described below.

The photosensitive layer (b) is charged positively. The other photosensitive layers are charged negatively.

The photosensitive layer (f) is sensitive to light of long wavelength. The other photosensitive layers are sensitive to white light.

Preparation of photosensitive layer (a)

Bisazo pigment, chloro-dian-blue (CDB) of 1 part by weight, polyester resin (V-200; made by Toyoboseki K. K.) of 1 part by weight and cyclohexanone of 100 parts by weight were taken in sand grinder for dispersion. The dispersion was mixed for 13 hours and applied onto a cylindrical aluminum substrate (80 mm in diameter×330 mm in length) by a dipping method so that the thickness of the dried layer would be 0.3 μm. Thus, a charge generating layer was prepared.

4-diethylaminobenzaldehyde-diphenyl hydrazone (DEH) of 1 part by weight and polycarbonate (K-1300; Teijin Kasei K. K.) of 1 part by weight were dissolved in tetrahydrofuran (THF) of 6 parts by weight. The obtained solution was applied onto the charge generating layer to form a charge transporting layer so that the thickness of the dried layer would be 15 μm.

Thus, an organic photosensitive layer (a) of 15 μm in thickness was prepared.

Preparation of photosensitive layer (b)

Specialty α-type phthalocyanine (made by Toyo Ink K. K.) of 25 parts by weight, thermosetting resin acrylic melamine (a mixture of A-405 with Super Beckamine J 820; made by Dainippon Ink K. K.) of 50 parts by weight, 4-diethylamino-benzaldehyde-diphenyl hydrazone of 25 parts by weight and organic solvent (mixture of xylene of 7 parts by weight with butanol of 3 parts by weight) of 500 parts by weight were mixed to disperse in a ball mill for 10 hours. The obtained dispersion was applied onto an cylindrical aluminum substrate (80 mm in diameter×330 mm in length) by a dipping method to prepare a photosensitive layer (b) so that the thickness of the layer would be 15 μm after baked at 150° C. for 1 hour.

Preparation of photosensitive layer (c)

Two parts by weight of Bisazo compound represented by the chemical formula [Ia] described later, polyester resin (V-500; made by Toyobo K. K.) of 1 part by weight and methyl ethyl ketone of 100 parts by weight were taken in a ball mill to disperse for 24 hours. The dispersion was applied onto a cylindrical aluminum substrate (80 mm in diameter×330 mm in length) by a dipping method to form a charge generating layer so that the thickness of the dried layer would be 3000 Å.

Then, 10 parts by weight of the hydrazone compound represented by the chemical formula [Ib] described later, 10 parts by weight of polycarbonate resin (K-1300; made by Teijin Kasei K. K.) were dissolved in Tetrahydrofuran of 80 parts by weight. The solution was applied onto the charge generating layer to form a charge transporting layer so that the thickness of the dried layer would be 20 μm. Thus, an organic photosensitive layer (c) was obtained.

Preparation of photosensitive layer (d)

Two parts by weight of Bisazo compound represented by the chemical formula [IIa] described later, polyester resin (V-500; made by Toyobo K. K.) of 1 part by weight and methyl ethyl ketone of 100 parts by weight were taken in a ball mill to disperse for 24 hours. The dispersion was applied onto a cylindrical aluminum substrate (80 mm in diameter×330 mm in length) by a dipping method to form a charge generating layer so that the thickness of the dried layer would be 2500 Å.

Then, 10 parts by weight of the styryl compound represented by the chemical formula [IIb] described later, 10 parts by weight of polyarylate resin (U-4000; made by Yunichica K. K.) were dissolved in Tetrahydrofuran of 85 parts by weight. The solution was applied onto the charge generating layer to form a charge transporting layer so that the thickness of the dried layer would be 20 μm. Thus, an organic photosensitive layer (d) was obtained.

Preparation of photosensitive layer (e)

Two parts by weight of Bisazo compound represented by the chemical formula [IIIa] described later, polyester resin (V-500; made by Toyobo K. K.) of 1 part by weight and methyl ethyl ketone of 100 parts by weight were taken in a ball mill to disperse for 24 hours. The dispersion was applied onto a cylindrical aluminum substrate (80 mm in diameter×330 mm in length) by a dipping method to form a charge generating layer so that the thickness of the dried layer would be 3000 Å.

Then, 10 parts by weight of the styryl compound represented by the chemical formula [IIIb] described later, 10 parts by weight of methyl methacrylate resin (BR-85; made by Mitsubishi Reiyon K. K.) were dissolved in Tetrahydrofuran of 80 parts by weight. The solution was applied onto the charge generating layer to form a charge transporting layer so that the thickness of the dried layer would be 20 μm. Thus, an organic photosensitive layer (e) was obtained.

Preparation of organic photosensitive layer (f)

Titanyl phthalocyanine (TiOPc) was deposited at $10^{-4}-10^{-6}$ Tort in degree of vacuum at 400°-500° C. in boat temperature by an electric resistance heating method. The deposition layer of TiOPc having 2500 Å in thickness was formed as a charge generating layer.

Then, 1 part by weight of p,p-bisdiethyl aminotetraphenylbutadiene and 1 part by weight of polycarbonate (K-1300; made by Teijin Kasei) were dissolved in tetrahydrofuran of 6 parts by weight. The obtained solution was applied onto the charge generating layer to form a charge transporting layer so that the thickness of the dried layer would be 15 μm. Thus, an organic photosensitive layer (f) was obtained.

Preparation of photosensitive layer (g)

Bisazo pigment, chloro-dian-blue (CDB) of 1 g, polyester resin (V-200; made by Toyobo K. K.) of 1 g and cyclohexanone of 98 g were taken in Sand grinder for dispersion. The dispersion was mixed for 13 hours, and applied onto a cylindrical substrate shown in Table 10 (80 mm in diameter×330 mm in length) by a dipping method so that the thickness of the dried layer would be 0.3 μm. Thus, a charge generating layer was prepared.

Pirazoline compound of 5 g represented by the chemical formula [V] described later and polycarbonate (K-1300; Teijin Kasei K. K.) of 10 g were dissolved in tetrahydrofuran (THF) of 50 g. The obtained solution was applied onto the charge generating layer to form a charge transporting layer so that the thickness of the dried layer would be 15 μm.

Thus, an organic photosensitive layer (g) of 15 μm in thickness was prepared.

[Ia]

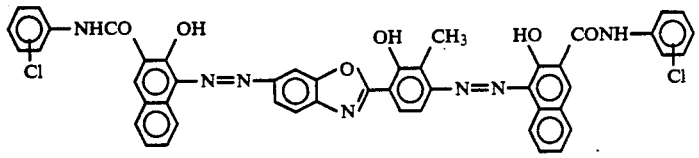

[Ib]

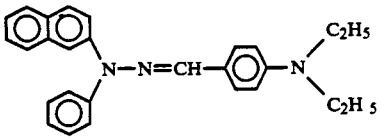

[IIa]

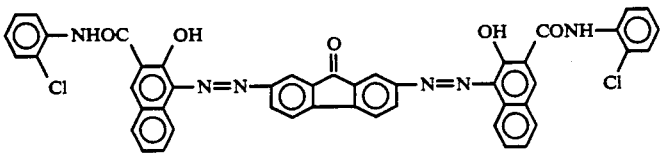

[IIb]

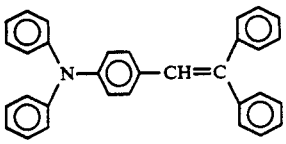

[IIIa]

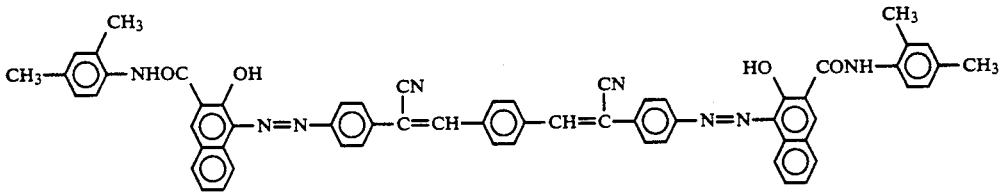

[IIIb]

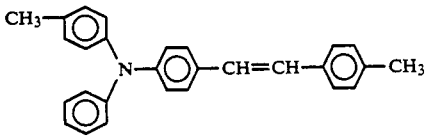

[IV]

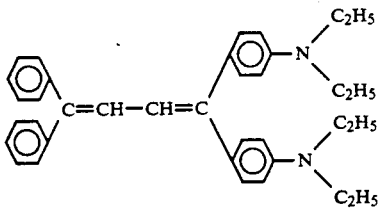

[V]

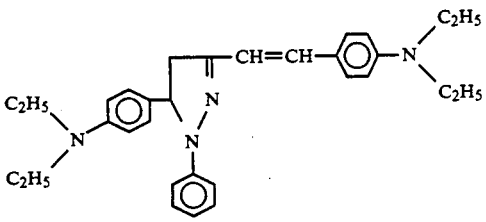

Washing of the photosensitive layer (a)

The photosensitive layer (a) was washed by the washing equipment shown in FIG. 1 after kept at 20° C. in temperature and 65% in humidity for 30 days.

In FIG. 1, the number (1) is the photosensitive drum having the photosensitive layer (a) on the substrate. The photosensitive drum is joined to the shaft (2) which is hydraulically operated and able to move up and down. The number (4) is a tank for washing with the capacity of 30 (length)×30 (width)×50 (height from bottom to top level of the solution) $cm^3$, and filled with a solvent for washing (5). The solvent for washing (5) is distilled and circulated by a circulator (6).

Ultrasonic vibration may be provided by an ultrasonic generator (7) in order to wash the drum (1) more effectively.

The washing was carried out as follows. The photosensitive drum (1) was lowered gradually by the hydraulically operated shaft (3) until the whole photosensitive drum was dipped into the solvent in the tank for washing (4).

The solvent amount used for washing in this Example was about 50 liters, which include the solvent contained in the circulator (6) and the pipes. The temperature of the solvent for washing was controlled to adjust to 20° C. by a temperature controller (not shown). The power of ultrasonic generator was adjusted to 500 W when used.

In the washing process, the solvent used in Examples 1-90 and Comparative Examples 1-6 are shown in Table 1. In each Example, dipping-operation time, dipping time, ultrasonic-operation time and raising-operation time were measured. The results are shown in Table 1.

1) dipping operation time:

Time required to dip the whole drum from the bottom to the top while the shaft was operated at a constant fall-off-rate.

For example, when the in dipping operation time is 30 seconds in the case where the length of the drum is 330 mm, it is meant that the shaft was lowered at the rate of 11 mm/see (330 mm/30 sec).

2) dipping time:

Time during the dipping of the whole drum in the solvent.

3) ultrasonic-operation time:

Time during the generation of ultrasonic vibration at the dipping time.

4) raising-operation time:

Opposite operation to the dipping operation. Time required to raise the whole drum from the top to the bottom out of the washing solvent.

The difference of dipping time between the top of the drum and the bottom of the drum in the solvent for washing was calculated by measuring the shortest time and longest time as shown below. The results are shown as difference of washing time.

5) shortest time:

Time during the dipping of the top of the drum in the solvent, being equal to dipping time.

6) longest time:

Time during dipping of the bottom of the drum in the solvent, which is equal to the total of dipping operation time, dipping time and raising-operation time.

Washing of the photosensitive layers (b)-(g)

The photosensitive layers (b)-(f) were washed under conditions shown in Table 1 in a manner similar to that of the photosensitive layer (a) after kept at 20° C. in temperature and 65% in humidity for 30 days.

TABLE 1

| | | | Washing Conditions | | | | difference of dipping time | | |
|---|---|---|---|---|---|---|---|---|---|
| Example No. | Organic photosensitive layer | solvent | dipping operation time (sec) | dipping time (sec) | ultrasonic-operation time (sec) | rasing-operation time (sec) | shortest time (sec) | longest time (sec) | difference (sec) |
| Example 1 | (a) | n-hexane | 30 | 10 | 0 | 30 | 10 | 70 | 60 |
| Example 2 | " | " | 30 | 15 | 0 | 30 | 15 | 75 | 60 |
| Example 3 | " | " | 30 | 20 | 0 | 30 | 20 | 80 | 60 |
| Example 4 | " | " | 30 | 30 | 0 | 30 | 30 | 90 | 60 |
| Example 5 | " | " | 30 | 60 | 0 | 30 | 60 | 120 | 60 |
| Example 6 | " | " | 30 | 300 | 0 | 30 | 300 | 360 | 60 |
| Example 7 | " | " | 30 | 600 | 0 | 30 | 600 | 660 | 60 |
| Example 8 | " | " | 30 | 1800 | 0 | 30 | 1800 | 1860 | 60 |
| Example 9 | (a) | n-hexane | 30 | 10 | 8 | 30 | 10 | 70 | 60 |
| Example 10 | " | " | 30 | 15 | 13 | 30 | 15 | 75 | 60 |
| Example 11 | " | " | 30 | 20 | 18 | 30 | 20 | 80 | 60 |
| Example 12 | (a) | n-hexane | 5 | 10 | 8 | 5 | 10 | 20 | 10 |
| Example 13 | " | " | 10 | 10 | 8 | 10 | 10 | 30 | 20 |
| Example 14 | " | " | 120 | 10 | 8 | 120 | 10 | 250 | 240 |
| Example 15 | " | " | 300 | 10 | 8 | 300 | 10 | 610 | 600 |
| Example 16 | (b) | n-hexane | same as those in Example 1 | | | | | | |
| Example 17 | " | " | same as those in Example 2 | | | | | | |
| Example 18 | " | " | same as those in Example 3 | | | | | | |
| Example 19 | " | " | same as those in Example 4 | | | | | | |
| Example 20 | " | " | same as those in Example 8 | | | | | | |
| Example 21 | " | " | same as those in Example 9 | | | | | | |
| Example 22 | (c) | n-hexane | same as those in Example 4 | | | | | | |
| Example 23 | " | " | same as those in Example 8 | | | | | | |
| Example 24 | (d) | " | same as those in Example 4 | | | | | | |
| Example 25 | " | " | same as those in Example 8 | | | | | | |
| Example 26 | (e) | " | same as those in Example 4 | | | | | | |
| Example 27 | " | " | same as those in Example 8 | | | | | | |
| Example 28 | (f) | " | same as those in Example 4 | | | | | | |
| Example 29 | " | " | same as those in Example 8 | | | | | | |
| Example 30 | (a) | methanol | same as those in Example 5 | | | | | | |
| Example 31 | " | ethanol | " | | | | | | |
| Example 32 | " | toluene | " | | | | | | |
| Example 33 | " | xylene | " | | | | | | |
| Example 34 | " | acetone | " | | | | | | |
| Example 35 | (a) | ethyl ether | same as those in Example 5 | | | | | | |
| Example 36 | " | ligroin | " | | | | | | |
| Example 37 | " | cyclohexanone | " | | | | | | |
| Example 38 | " | " | " | | | | | | |
| Example 39 | (a) | n-hexane | " | | | | | | |
| Example 40 | " | " | " | | | | | | |
| Example 41 | " | " | " | | | | | | |

TABLE 1-continued

| Example No. | Organic photosensitive layer | solvent | Washing Conditions: dipping operation time (sec) | dipping time (sec) | ultrasonic-operation time (sec) | rasing-operation time (sec) | difference of dipping time: shortest time (sec) | longest time (sec) | difference (sec) |
|---|---|---|---|---|---|---|---|---|---|
| Example 42 | " | " | | | | " | | | |
| Example 43 | " | " | | | | " | | | |
| Example 44 | " | " | | | | " | | | |
| Example 45 | (a) | *flon-113 | | | | same as those in Example 1 | | | |
| Example 46 | " | " | | | | same as those in Example 2 | | | |
| Example 47 | " | " | | | | same as those in Example 3 | | | |
| Example 48 | " | " | | | | same as those in Example 4 | | | |
| Example 49 | " | " | | | | same as those in Example 5 | | | |
| Example 50 | " | " | | | | same as those in Example 6 | | | |
| Example 51 | " | " | | | | same as those in Example 7 | | | |
| Example 52 | " | " | | | | same as those in Example 8 | | | |
| Example 53 | " | " | | | | same as those in Example 9 | | | |
| Example 54 | " | " | | | | same as those in Example 10 | | | |
| Example 55 | " | " | | | | same as those in Example 11 | | | |
| Comparative Example 1 | (a) | | | | | none-washing | | | |
| Comparative Example 2 | (b) | | | | | " | | | |
| Comparative Example 3 | (c) | | | | | " | | | |
| Comparative Example 4 | (d) | | | | | " | | | |
| Comparative Example 5 | (e) | | | | | " | | | |
| Comparative Example 6 | (f) | | | | | " | | | |
| Example 56 | (a) | *5 F P | | | | same as those in Example 1 | | | |
| Example 57 | " | " | | | | same as those in Example 2 | | | |
| Example 58 | " | " | | | | same as those in Example 3 | | | |
| Example 59 | " | " | | | | same as those in Example 4 | | | |
| Example 60 | " | " | | | | same as those in Example 5 | | | |
| Example 61 | " | " | | | | same as those in Example 6 | | | |
| Example 62 | " | " | | | | same as those in Example 7 | | | |
| Example 63 | " | " | | | | same as those in Example 8 | | | |
| Example 64 | (a) | 5 F P | | | | same as those in Example 9 | | | |
| Example 65 | " | " | | | | same as those in Example 10 | | | |
| Example 66 | " | " | | | | same as those in Example 11 | | | |
| Example 67 | (a) | 5 F P | | | | same as those in Example 12 | | | |
| Example 68 | " | " | | | | same as those in Example 13 | | | |
| Example 69 | " | " | | | | same as those in Example 14 | | | |
| Example 70 | " | " | | | | same as those in Example 15 | | | |
| Example 71 | (b) | 5 F P | | | | same as those in Example 1 | | | |
| Example 72 | " | " | | | | same as those in Example 2 | | | |
| Example 73 | " | " | | | | same as those in Example 3 | | | |
| Example 74 | " | " | | | | same as those in Example 4 | | | |
| Example 75 | " | " | | | | same as those in Example 8 | | | |
| Example 76 | " | " | | | | same as those in Example 9 | | | |
| Example 77 | (c) | 5 F P | | | | same as those in Example 4 | | | |
| Example 78 | " | " | | | | same as those in Example 8 | | | |
| Example 79 | (d) | " | | | | same as those in Example 4 | | | |
| Example 80 | " | " | | | | same as those in Example 8 | | | |
| Example 81 | (c) | " | | | | same as those in Example 4 | | | |
| Example 82 | " | " | | | | same as those in Example 8 | | | |
| Example 83 | (f) | " | | | | same as those in Example 4 | | | |
| Example 84 | " | " | | | | same as those in Example 8 | | | |
| Example 85 | (a) | 5 F P | | | | same as those in Example 5 | | | |
| Example 86 | " | " | | | | " | | | |
| Example 87 | " | " | | | | " | | | |
| Example 88 | " | " | | | | " | | | |
| Example 89 | " | " | | | | " | | | |
| Example 90 | " | " | | | | " | | | |

*flon-113

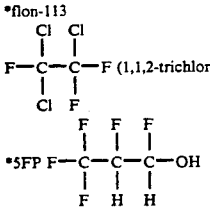

Formation of a surface protective layer

A surface protective layer was formed on the photosensitive layer (a) after the photosensitive layer was washed.

Figure 2:
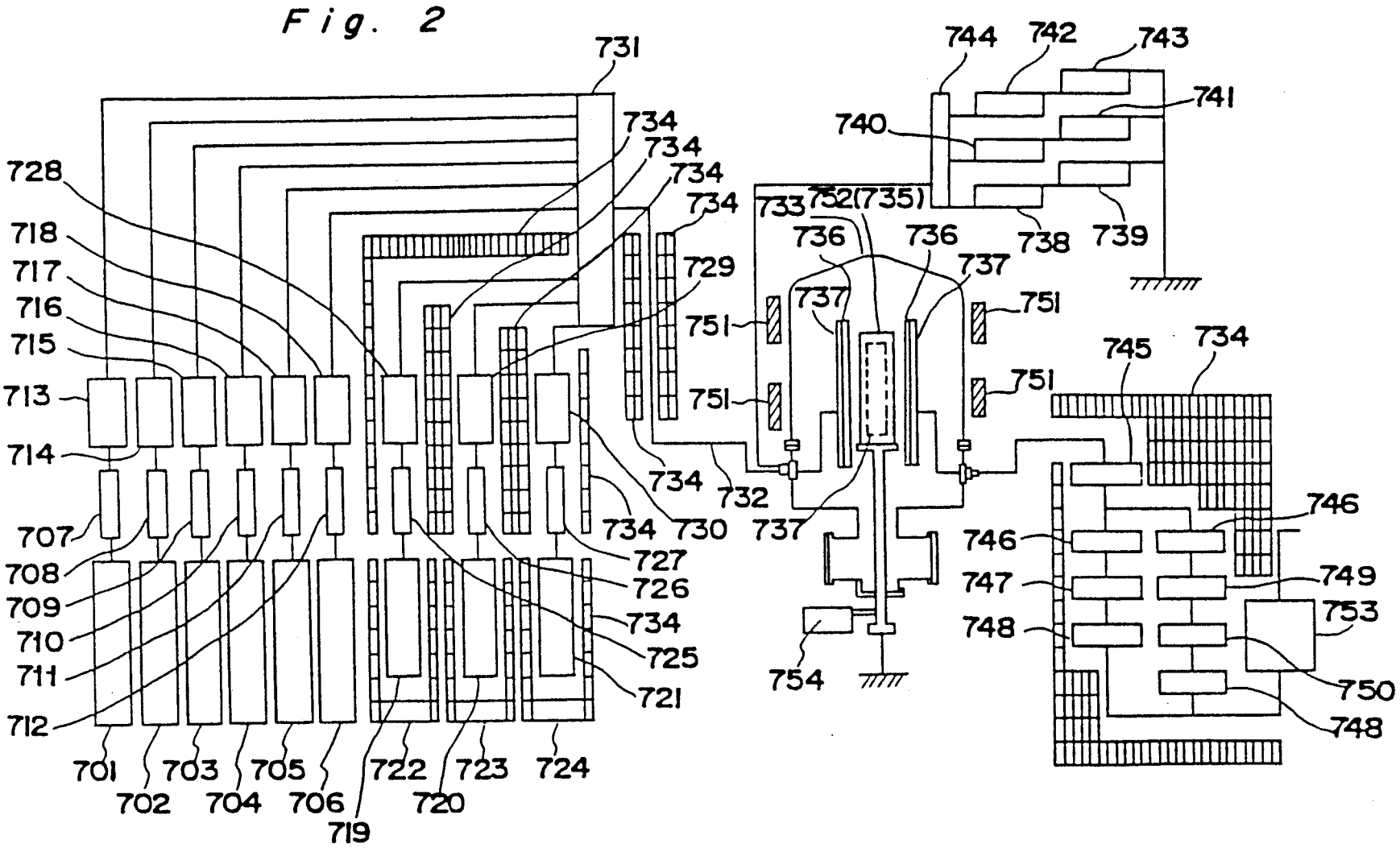
FIG. 2 shows a schematic view of a glow discharge equipment.

In a system of glow discharge decomposition equipment as illustrated in FIG. 2, first the reaction chamber (733) was vacuumized inside to a high level of approximately $10^{-6}$ Tort, and then by opening No. 1 and No. 2 regulating valves (707) and (708), hydrogen gas from No. 1 tank (701) and butadiene gas from No. 2 tank (702) were led, under output pressure gage reading of 1 $Kg/cm^2$, into mass flow controllers (713) and (714). Then, the mass flow controllers were set so as to make hydrogen gas flow at 300 sccm and butadiene gas flow at 30 sccm, and the gases were allowed into the reaction chamber (733). After the respective flows had stabilized, the internal pressure of the reaction chamber (733) was adjusted to 0.5 Tort. On the other hand, the electrically conductive substrate (752), which was the organic photosensitive layer (a), was preliminarily heated up to 50° C., and while the gas flows and the internal pressure were stabilized, it was connected to the low frequency power source (741) and 180 watts power (frequency:100 KHz) was applied to the power-applying electrode (736). After plasma polymerization for for about 180 seconds, there was formed an amorphous carbon layer (a-C layer) of 1200 Å in thickness on the photosensitive layer as a surface protective layer.

After the formation of the surface protective layer, the electrical power supply was stopped, the regulating valves were closed and the chamber was vacuumized inside. Then, the vacuum was broken to take out the photosensitive member of the present invention.

With respect to the photosensitive layers (b)–(g), surface protective layers were formed under conditions shown in Table 2 in a manner similar to that described above.

TABLE 2

| Example No. | Organic photosensitive layer | material gas flow rate(sccm) gas | gas | electric power (W) | pressure (Torr) | frequency (KHz) | substrate (°C.) | layer formation time(sec) | layer thickness Å |
|---|---|---|---|---|---|---|---|---|---|
| Example 1 | (a) | hydrogen:300 | butadiene:30 | 180 | 0.5 | 100 | 50 | 180 | 1200 |
| Example 2 | " | " | " | " | " | " | " | " | " |
| Example 3 | " | " | " | " | " | " | " | " | " |
| Example 4 | " | " | " | " | " | " | " | " | " |
| Example 5 | " | " | " | " | " | " | " | " | " |
| Example 6 | " | " | " | " | " | " | " | " | " |
| Example 7 | " | " | " | " | " | " | " | " | " |
| Example 8 | " | " | " | " | " | " | " | " | " |
| Example 9 | (a) | " | " | " | " | " | " | " | " |
| Example 10 | " | " | " | " | " | " | " | " | " |
| Example 11 | " | " | " | " | " | " | " | " | " |
| Example 12 | (a) | " | " | " | " | " | " | " | " |
| Example 13 | " | " | " | " | " | " | " | " | " |
| Example 14 | " | " | " | " | " | " | " | " | " |
| Example 15 | " | " | " | " | " | " | " | " | " |
| Example 16 | (b) | | | same as those in Example 1 | | | | | |
| Example 17 | " | | | same as those in Example 2 | | | | | |
| Example 18 | " | | | same as those in Example 3 | | | | | |
| Example 19 | " | | | same as those in Example 4 | | | | | |
| Example 20 | " | | | same as those in Example 8 | | | | | |
| Example 21 | " | | | same as those in Example 9 | | | | | |
| Example 22 | (c) | | | same as those in Example 4 | | | | | |
| Example 23 | " | | | same as those in Example 8 | | | | | |
| Example 24 | (d) | | | same as those in Example 4 | | | | | |
| Example 25 | " | | | same as those in Example 8 | | | | | |
| Example 26 | (e) | | | same as those in Example 4 | | | | | |
| Example 27 | " | | | same as those in Example 8 | | | | | |
| Example 28 | (f) | | | same as those in Example 4 | | | | | |
| Example 29 | " | | | same as those in Example 8 | | | | | |
| Example 30 | (a) | | | same as those in Example 5 | | | | | |
| Example 31 | " | | | " | | | | | |
| Example 32 | " | | | " | | | | | |
| Example 33 | " | | | " | | | | | |
| Example 34 | " | | | " | | | | | |
| Example 35 | (a) | | | same as those in Example 5 | | | | | |
| Example 36 | " | | | " | | | | | |
| Example 37 | " | | | " | | | | | |
| Example 38 | " | | | " | | | | | |
| Example 39 | (a) | helium:300 | butadiene:30 | 180 | 0.5 | 100 | 50 | 250 | 1200 |
| Example 40 | " | hydrogen:300 | propylene:30 | 180 | 0.5 | 100 | 50 | 240 | 1200 |
| Example 41 | " | hydrogen:300 | butadiene:30 | 360 | 0.5 | 100 | 50 | 115 | 1200 |
| Example 42 | " | hydrogen:300 | butadiene:30 | 180 | 1 | 100 | 50 | 200 | 1200 |
| Example 43 | " | hydrogen:300 | butadiene:30 | 180 | 0.5 | 13.56 MHz | 50 | 280 | 1200 |
| Example 44 | " | hydrogen:300 | butadiene:30 | 180 | 0.5 | 100 | 30 | 180 | 1200 |
| Example 45 | (a) | | | same as those in Example 1 | | | | | |
| Example 46 | " | | | same as those in Example 2 | | | | | |
| Example 47 | " | | | same as those in Example 3 | | | | | |
| Example 48 | " | | | same as those in Example 4 | | | | | |
| Example 49 | " | | | same as those in Example 5 | | | | | |
| Example 50 | " | | | same as those in Example 6 | | | | | |
| Example 51 | " | | | same as those in Example 7 | | | | | |
| Example 52 | " | | | same as those in Example 8 | | | | | |
| Example 53 | " | | | same as those in Example 9 | | | | | |
| Example 54 | " | | | same as those in Example 10 | | | | | |
| Example 55 | " | | | same as those in Example 11 | | | | | |

TABLE 2-continued

| Example No. | Organic photosensitive layer | material gas flow rate(sccm) gas | gas | electric power (W) | pressure (Torr) | frequency (KHz) | substrate (°C.) | layer formation time(sec) | layer thickness Å |
|---|---|---|---|---|---|---|---|---|---|
| Comparative Example | | | | | | | | | |
| 1 | (a) | | | same as those in Example 5 | | | | | |
| 2 | (b) | | | " | | | | | |
| 3 | (c) | | | " | | | | | |
| 4 | (d) | | | " | | | | | |
| 5 | (e) | | | " | | | | | |
| 6 | (f) | | | " | | | | | |
| Example 56 | (a) | | | same as those in Example 1 | | | | | |
| Example 57 | " | | | same as those in Example 2 | | | | | |
| Example 58 | " | | | same as those in Example 3 | | | | | |
| Example 59 | " | | | same as those in Example 4 | | | | | |
| Example 60 | " | | | same as those in Example 5 | | | | | |
| Example 61 | " | | | same as those in Example 6 | | | | | |
| Example 62 | " | | | same as those in Example 7 | | | | | |
| Example 63 | " | | | same as those in Example 8 | | | | | |
| Example 64 | " | | | same as those in Example 9 | | | | | |
| Example 65 | " | | | same as those in Example 10 | | | | | |
| Example 66 | " | | | same as those in Example 11 | | | | | |
| Example 67 | " | | | same as those in Example 12 | | | | | |
| Example 68 | " | | | same as those in Example 13 | | | | | |
| Example 69 | " | | | same as those in Example 14 | | | | | |
| Example 70 | " | | | same as those in Example 15 | | | | | |
| Example 71 | (b) | | | same as those in Example 1 | | | | | |
| Example 72 | " | | | same as those in Example 2 | | | | | |
| Example 73 | " | | | same as those in Example 3 | | | | | |
| Example 74 | " | | | same as those in Example 4 | | | | | |
| Example 75 | " | | | same as those in Example 8 | | | | | |
| Example 76 | " | | | same as those in Example 9 | | | | | |
| Example 77 | (c) | | | same as those in Example 4 | | | | | |
| Example 78 | " | | | same as those in Example 8 | | | | | |
| Example 79 | (d) | | | same as those in Example 4 | | | | | |
| Example 80 | " | | | same as those in Example 8 | | | | | |
| Example 81 | (e) | | | same as those in Example 4 | | | | | |
| Example 82 | " | | | same as those in Example 8 | | | | | |
| Example 83 | (f) | | | same as those in Example 4 | | | | | |
| Example 84 | " | | | same as those in Example 8 | | | | | |
| Example 85 | (a) | | | same as those in Example 39 | | | | | |
| Example 86 | " | | | same as those in Example 40 | | | | | |
| Example 87 | " | | | same as those in Example 41 | | | | | |
| Example 88 | " | | | same as those in Example 42 | | | | | |
| Example 89 | " | | | same as those in Example 43 | | | | | |
| Example 90 | " | | | same as those in Example 44 | | | | | |

Measurement of surface potential of photosensitive member (Before Formation of Surface Protective Layer)

Figure 3:
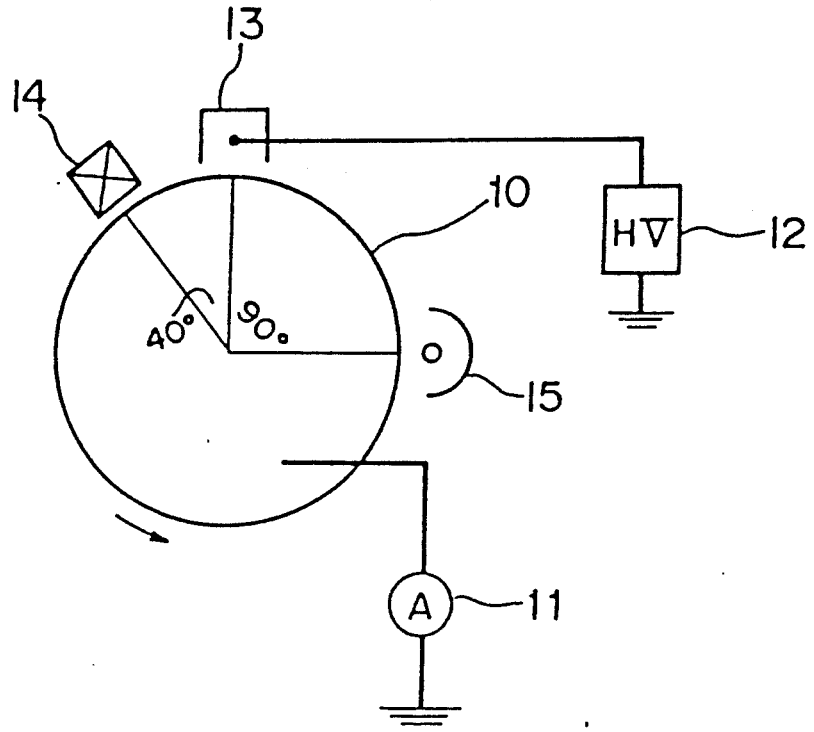
FIG. 3 shows a schematic view of a surface potential-measuring system.

A photosensitive drum (10) which did not have a surface protective layer was set as shown in FIG. 3 and then revolved at 130 mm/sec in peripheral speed. Electric power was provided with a scorotoron charger (13) from a power source for high voltage (12) (MODEL 610A; made by TREK K. K.) to charge the surface of a photosensitive layer to the level of 500 V. Charge potential was measured by a surface potentiometer (14) (MODEL 362A; made by TREK K. K.), and electrical current "a" (μA) was read by an ammeter (11) at the same time.

Figure 4:
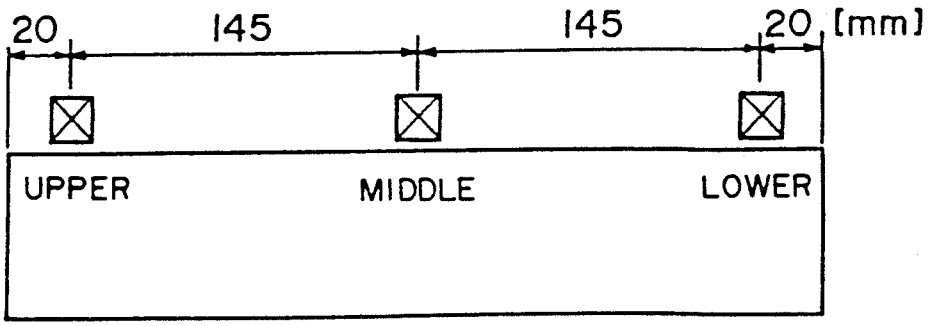
FIG. 4 shows the positions where potentiometers are set.

The surface potentiometers were set at three positions along the longer direction of the drum as shown in FIG. 4 in order to measure potential at the upper, middle, and lower positions of the drum at the same time. The electrical current "a" (μA) was read when average voltage of the three surface potentiometers was 500 V. However, the difference of surface potential at the upper, middle and lower positions of the drum was within ±5 V in all Examples. Electric charges on the surface of the photosensitive layer were erased by an eraser lamp (15) (tungsten lamp, 2800° K. in color temperature, 40[lux·sec]).

(After Formation of Surface Protective Layer)

A photosensitive drum having a surface protective layer was set. The output power of the charger (13) was adjusted so that the ammeter (11) might read a [μA] again. Then, the surface potential (14) was read at the upper, middle and the lower positions by the three surface potentiometers (14). The difference of the surface potential before and after the formation of surface protective layer was calculated to evaluate the present invention The evaluations were ranked by the symbols "o", "Δ" and "x" on the basis of the fall-off from the initial surface potential of 500 V.

| symbol | potential fall-off | evaluation |
|---|---|---|
| o | 30 V or less | no fall-off; fall-off of potential was within margin of error |
| Δ | more than 30 V ~ 80 V or less | a little fall-off of potential was observed; no problem in practical use; |
| x | more than 80 V | fall-off of potential was observed; not suitable for practical use; |

Evaluation of Uniformity of Charging Potential

The uniformity of charging potential in circumferential direction was evaluated on the basis of the difference between the maximum potential and the minimum potential.

| symbol | difference of $V_0$ | evaluation |
|---|---|---|
| ○ | 30 V or less | no difference; $V_0$ difference was within margin of error |
| Δ | more than 30 V ~ 80 V or less | a little difference of $V_0$ was observed; no problem in practical use |
| x | more than 80 V | difference of $V_0$ was observed; not suitable for practical use |

The uniformity of charging potential in the longer direction of the drum was evaluated on the basis of the difference between the maximum potential and minimum potential among the upper, middle and lower positions.

| symbol | difference of $V_0$ | evaluation |
|---|---|---|
| ○ | 50 V or less | no difference; $V_0$ difference was within margin of error |
| Δ | more than 50 V ~ 100 V or less | a little difference of $V_0$ was observed; no problem in practical use |
| ○ | more than 100 V | difference of $V_0$ was observed; not suitable for practical use |

Evaluation of Adhesivity

The adhesivity of surface protective layer was evaluated at the three positions, i.e. the upper, middle and lower positions of the drum on the basis of the cross-cut adhesion test according to JIS-K-5400.

| symbol | points in the cross-cut adhesion test | evaluation |
|---|---|---|
| ○ | 10 points | excellent; a-C layer did not separate. |
| Δ | 8 points or more | a-C layer separated a little; no problem in practical use. |
| x | less than 8 points | a-C layer separated; not suitable for practical use. |

Evaluation of Copied Images

The obtained photosensitive member (having a surface protective layer) was installed in a copying machine. The copied images were evaluated visually. The copying machine was EP490Z (made by Minolta Camera K. K.). However, the photosensitive member containing the photosensitive layer (b) was installed in the copying machine for reverse development. The photosensitive member containing the photosensitive layer (f) was installed in the copying machine which could emit semiconducting laser.

The symbol "o" means that the good copied images were formed. The symbol "Δ" means that copied images had no practical problems. The symbol "x" means that copied images were poor in quality.

The results of evaluation on each photosensitive layer were summarized in Table 3 and Table 4.

TABLE 3

| Example | $V_0$ after coated | | | $V_0$ uniformity | | | | adhesivity | | | |
|---|---|---|---|---|---|---|---|---|---|---|---|
| | | | | circumferential direction | | | longer | drum | | | images |
| No. | upper | middle | lower | upper | middle | lower | direction | upper | middle | lower | copied |
| 1 | ○ | ○ | ○ | ○ | ○ | ○ | ○ | Δ | Δ | Δ | Δ |
| 2 | ○ | ○ | ○ | ○ | ○ | ○ | ○ | Δ | Δ | ○ | Δ |
| 3 | ○ | ○ | ○ | ○ | ○ | ○ | ○ | Δ | ○ | ○ | Δ |
| 4 | ○ | ○ | ○ | ○ | ○ | ○ | ○ | ○ | ○ | ○ | ○ |
| 5 | ○ | ○ | ○ | ○ | ○ | ○ | ○ | ○ | ○ | ○ | ○ |
| 6 | ○ | ○ | ○ | ○ | ○ | ○ | ○ | ○ | ○ | ○ | ○ |
| 7 | ○ | ○ | ○ | ○ | ○ | ○ | ○ | ○ | ○ | ○ | ○ |
| 8 | ○ | ○ | ○ | ○ | ○ | ○ | ○ | ○ | ○ | ○ | ○ |
| 9 | ○ | ○ | ○ | ○ | ○ | ○ | ○ | ○ | ○ | ○ | ○ |
| 10 | ○ | ○ | ○ | ○ | ○ | ○ | ○ | ○ | ○ | ○ | ○ |
| 11 | ○ | ○ | ○ | ○ | ○ | ○ | ○ | ○ | ○ | ○ | ○ |
| 12 | ○ | ○ | ○ | ○ | ○ | ○ | ○ | ○ | ○ | ○ | ○ |
| 13 | ○ | ○ | ○ | ○ | ○ | ○ | ○ | ○ | ○ | ○ | ○ |
| 14 | ○ | ○ | ○ | ○ | ○ | ○ | ○ | ○ | ○ | ○ | ○ |
| 15 | ○ | ○ | ○ | ○ | ○ | ○ | ○ | ○ | ○ | ○ | ○ |
| 16 | ○ | ○ | ○ | ○ | ○ | ○ | ○ | Δ | Δ | Δ | Δ |
| 17 | ○ | ○ | ○ | ○ | ○ | ○ | ○ | Δ | Δ | ○ | Δ |
| 18 | ○ | ○ | ○ | ○ | ○ | ○ | ○ | Δ | ○ | ○ | Δ |
| 19 | ○ | ○ | ○ | ○ | ○ | ○ | ○ | ○ | ○ | ○ | ○ |
| 20 | ○ | ○ | ○ | ○ | ○ | ○ | ○ | ○ | ○ | ○ | ○ |
| 21 | ○ | ○ | ○ | ○ | ○ | ○ | ○ | ○ | ○ | ○ | ○ |
| 22 | ○ | ○ | ○ | ○ | ○ | ○ | ○ | ○ | ○ | ○ | ○ |
| 23 | ○ | ○ | ○ | ○ | ○ | ○ | ○ | ○ | ○ | ○ | ○ |
| 24 | ○ | ○ | ○ | ○ | ○ | ○ | ○ | ○ | ○ | ○ | ○ |
| 25 | ○ | ○ | ○ | ○ | ○ | ○ | ○ | ○ | ○ | ○ | ○ |
| 26 | ○ | ○ | ○ | ○ | ○ | ○ | ○ | ○ | ○ | ○ | ○ |
| 27 | ○ | ○ | ○ | ○ | ○ | ○ | ○ | ○ | ○ | ○ | ○ |
| 28 | ○ | ○ | ○ | ○ | ○ | ○ | ○ | ○ | ○ | ○ | ○ |
| 29 | ○ | ○ | ○ | ○ | ○ | ○ | ○ | ○ | ○ | ○ | ○ |
| 30 | ○ | ○ | ○ | ○ | ○ | ○ | ○ | ○ | ○ | ○ | ○ |
| 31 | ○ | ○ | ○ | ○ | ○ | ○ | ○ | ○ | ○ | ○ | ○ |
| 32 | ○ | ○ | ○ | ○ | ○ | ○ | ○ | ○ | ○ | ○ | ○ |
| 33 | ○ | ○ | ○ | ○ | ○ | ○ | ○ | ○ | ○ | ○ | ○ |
| 34 | ○ | ○ | ○ | ○ | ○ | ○ | ○ | ○ | ○ | ○ | ○ |
| 35 | ○ | ○ | ○ | ○ | ○ | ○ | ○ | ○ | ○ | ○ | ○ |

TABLE 3-continued

| Example No. | $V_0$ after coated | | | $V_0$ uniformity circumferential direction | | | $V_0$ uniformity longer direction | adhesivity drum | | | images copied |
|---|---|---|---|---|---|---|---|---|---|---|---|
| | upper | middle | lower | upper | middle | lower | | upper | middle | lower | |
| 36 | o | o | o | o | o | o | o | o | o | o | o |
| 37 | o | o | o | o | o | o | o | o | o | o | o |
| 38 | o | o | o | o | o | o | o | o | o | o | o |
| 39 | o | o | o | o | o | o | o | o | o | o | o |
| 40 | o | o | o | o | o | o | o | o | o | o | o |
| 41 | o | o | o | o | o | o | o | o | o | o | o |
| 42 | o | o | o | o | o | o | o | o | o | o | o |
| 43 | o | o | o | o | o | o | o | o | o | o | o |
| 44 | o | o | o | o | o | o | o | o | o | o | o |
| 45 | o | o | o | x | x | x | x | Δ | Δ | Δ | x |
| 46 | o | o | Δ | x | x | x | x | Δ | Δ | o | x |
| 47 | o | Δ | x | x | x | x | x | Δ | o | o | x |
| 48 | Δ | x | x | x | x | x | x | o | o | o | x |
| 49 | x | x | x | x | Δ | Δ | x | o | o | o | x |
| 50 | x | x | x | Δ | Δ | Δ | Δ | o | o | o | x |
| 51 | x | x | x | Δ | Δ | Δ | Δ | o | o | o | x |
| 52 | x | x | x | Δ | Δ | Δ | Δ | o | o | o | x |
| 53 | x | x | x | x | x | x | x | o | o | o | x |
| 54 | x | x | x | x | x | x | x | o | o | o | x |
| 55 | x | x | x | x | x | x | x | o | o | o | x |
| comparative Example | | | | | | | | | | | |
| 1 | o | o | o | Δ | Δ | Δ | Δ | x | x | x | x |
| 2 | o | o | o | Δ | Δ | Δ | Δ | x | x | x | x |
| 3 | o | o | o | Δ | Δ | Δ | Δ | x | x | x | x |
| 4 | o | o | o | Δ | Δ | Δ | Δ | x | x | x | x |
| 5 | o | o | o | Δ | Δ | Δ | Δ | x | x | x | x |
| 6 | o | o | o | Δ | Δ | Δ | Δ | x | x | x | x |

TABLE 4

| Example No. | $V_0$ after coated | | | $V_0$ uniformity circumferential direction | | | $V_0$ uniformity longer direction | adhesivity drum | | | images copied |
|---|---|---|---|---|---|---|---|---|---|---|---|
| | upper | middle | lower | upper | middle | lower | | upper | middle | lower | |
| 56 | o | o | o | o | o | o | o | Δ | Δ | Δ | Δ |
| 57 | o | o | o | o | o | o | o | Δ | Δ | o | Δ |
| 58 | o | o | o | o | o | o | o | Δ | o | o | Δ |
| 59 | o | o | o | o | o | o | o | o | o | o | o |
| 60 | o | o | o | o | o | o | o | o | o | o | o |
| 61 | o | o | o | o | o | o | o | o | o | o | o |
| 62 | o | o | o | o | o | o | o | o | o | o | o |
| 63 | o | o | o | o | o | o | o | o | o | o | o |
| 64 | o | o | o | o | o | o | o | o | o | o | o |
| 65 | o | o | o | o | o | o | o | o | o | o | o |
| 66 | o | o | o | o | o | o | o | o | o | o | o |
| 67 | o | o | o | o | o | o | o | o | o | o | o |
| 68 | o | o | o | o | o | o | o | o | o | o | o |
| 69 | o | o | o | o | o | o | o | o | o | o | o |
| 70 | o | o | o | o | o | o | o | o | o | o | o |
| 71 | o | o | o | o | o | o | o | Δ | Δ | Δ | Δ |
| 72 | o | o | o | o | o | o | o | Δ | Δ | o | Δ |
| 73 | o | o | o | o | o | o | o | Δ | o | o | Δ |
| 74 | o | o | o | o | o | o | o | o | o | o | o |
| 75 | o | o | o | o | o | o | o | o | o | o | o |
| 76 | o | o | o | o | o | o | o | o | o | o | o |
| 77 | o | o | o | o | o | o | o | o | o | o | o |
| 78 | o | o | o | o | o | o | o | o | o | o | o |
| 79 | o | o | o | o | o | o | o | o | o | o | o |
| 80 | o | o | o | o | o | o | o | o | o | o | o |
| 81 | o | o | o | o | o | o | o | o | o | o | o |
| 82 | o | o | o | o | o | o | o | o | o | o | o |
| 83 | o | o | o | o | o | o | o | o | o | o | o |
| 84 | o | o | o | o | o | o | o | o | o | o | o |
| 85 | o | o | o | o | o | o | o | o | o | o | o |
| 86 | o | o | o | o | o | o | o | o | o | o | o |
| 87 | o | o | o | o | o | o | o | o | o | o | o |
| 88 | o | o | o | o | o | o | o | o | o | o | o |
| 89 | o | o | o | o | o | o | o | o | o | o | o |
| 90 | o | o | o | o | o | o | o | o | o | o | o |

In Examples 1–8, the organic photosensitive layer (a) was washed with n-hexane (non-chlorinated solvent) under different dipping time to evaluate the present invention. When the dipping time was short (Examples 1–3), there was no practical problem. However, some photosensitive members showed a little poor adhesivity. On the whole, the photosensitive members obtained in Examples 1–3 were more excellent than those obtained in Comparative Examples 1–6.

In Examples 9–11, ultrasonic vibration was provided at the washing of the photosensitive layers. The adhesivity was improved although it was a little poor in Examples 1–3. The fall-off of the initial surface potential ($V_0$) was not observed.

In Examples 12–15, the dipping-operation time and the rasing operation time were changed. The difference of the photosensitive properties were not observed at the upper and lower positions of the photosensitive member.

Examples 16–29 show that the present invention can be applied to various kinds of photosensitive layers.

Examples 30–38 show that various kinds of non-chlorinated solvents can be applied to the washing process of the present invention.

In Examples 39–44, a-C layers were formed under different conditions. It is understood that the conditions for forming a surface protective layer do not influence adversely on the effects of the present invention.

In Examples 45–55, chlorinated solvent was used in the washing process of the photosensitive layer (a), followed by formation of surface protective layers of amorphous carbon. It is understood that adhesivity was improved. However, the fall-off of the initial surface potential was observed.

When the dipping time in chlorinated solvent was much longer, or when the ultrasonic vibration was provided for the washing process, the fall-off of the surface potential was observed after the surface protective layer was formed. Therefore, the evaluations on $V_0$ were ranked as "x" in Examples 47–55.

The fall-off of the surface potential caused the fall-off of the density of copied images. Therefore, the evaluation on copied images was ranked as "x".

On the other hand, the dipping time in chlorinated solvent was so short that the dripping of solvent caused the difference of surface potential between the portions where the solvent dripped and the portions where the solvent did not drip. Noticeable difference of initial surface potential ($V_0$) were observed. Therefore, the uniformity of $V_0$ was evaluated as "x" in Examples 45–49. Further, there formed copied images having the shade in accordance with the pattern of dripping of solvent. Therefore, the copied images were evaluated as "x".

As the dipping time becomes long in Examples 50–53, the $V_0$ was lowered. As a result, the difference of $V_0$ became small, with the result that uniformity of $V_0$ was evaluated as "Δ".

In Comparative Examples 1–6, the photosensitive layers (a)–(f) (which were kept at 20° C. in temperature and 65% in humidity for 30 days) were not subjected to the washing process before surface protective layers (a-C layers) were formed.

As can be seen from the adhesivity item in Table 3, the photosensitive members prepared in Comparative Examples 1–6 were ranked as "x". It is understood that the oxidized layer influenced adversely on the adhesivity of the a-C layer to the photosensitive layer. Needless to say, when an a-C layer does not adhere to photosensitive layer, the primary object to improve the durability of a photosensitive member can not be achieved.

The natural and partial separation of the surface protective layers prepared in Comparative Examples 1–6 was observed. Therefore, the initial surface potential was different between the portion where the surface protective layer adhered and the portion where the surface protective layer did not adhere. As a result, the evaluation on the uniformity of $V_0$ was ranked as "Δ".

With respect to evaluations on copied images in Comparative Examples 1–6, separated leaves of a-C layers were adhered to copying paper. Further, the separated leaves were included into the developing machine and caught between the levelling member of magnetic brushes and the developing sleeve or between the photosensitive member and the developing sleeve, and consequently, the smooth stream of a developer was obstructed to bring about developing failure. As a result, the evaluation on copied images was ranked as "x".

Formation of Surface Protective Layer ($Al_2O_3$)

Photosensitive members were prepared and evaluated in a manner similar to Example 1, Example 45 and Comparative Example 1, except that thin layers of $Al_2O_3$ were formed as a surface protective layer instead of an a-C layer under the conditions below by a usual sputtering apparatus;

Target:
Substrate Temperature:50° C.
Distance of Discharge (the distance between target and substrate):50 mm
Degree of Vacuum:$2\times10^{-4}$ Torr
Gas for Discharge:Ar
Electric Power for Discharge:2.0 KW
Frequency for Discharge:13.56 MHz
Time for Discharge:12 minutes
Thickness of $Al_2O_3$ layer:1800 Å

The results were the same as those in Example 1, Example 45 and Comparative Example 1.

Formation of Surface Protective Layer (SiO)

Photosensitive members were prepared and evaluated in a manner similar to Example 1, Example 45 and Comparative Example 1 except that thin layers of SiO were formed as a surface protective layer instead of an a-C layer under the conditions below by a usual depositing apparatus (heating method in vacuum).

Source for Deposition:SiO
Substrate Temperature:50° C.
Boat Temperature:1200° C.
Degree of Vacuum:$8.0\times10^{-5}$
Deposition Time:5 minutes
Thickness of SiO layer:1300 Å

The results were the same as those in Example 1, Example 45 and Comparative Example 1.

It is understood that the present invention can be applied to the preparation of a photosensitive member having a thin layer deposited under vacuum conditions as a surface protective layer, not being restricted to a photosensitive member having an a-C layer as a surface protective layer.

Wearing of Photosensitive Layer

Figure 5:
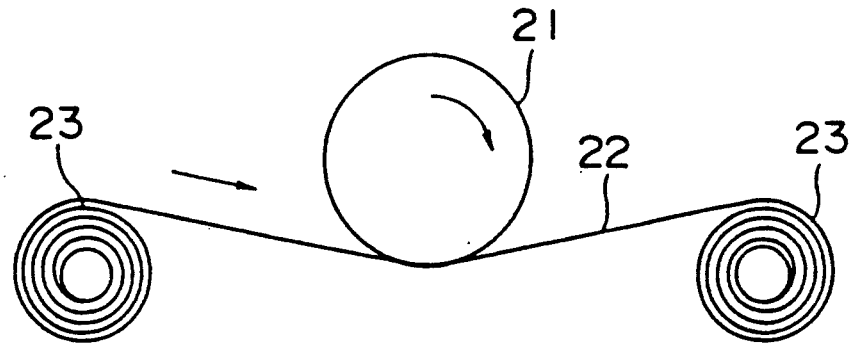
FIG. 5 shows a schematic wearing method with felt.
Figure 6:
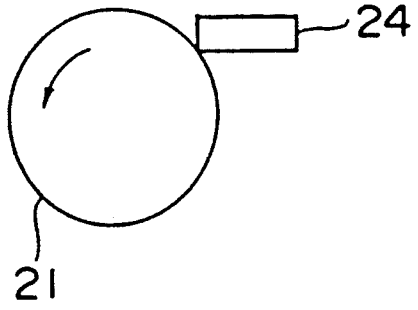
FIG. 6 shows a schematic wearing method with blade.

The photosensitive layers (a)–(g) were worn by felt as shown in FIG. 5 or by a blade as shown in FIG. 6 after kept at 20° C. in temperature and 65% in humidity for 30 days.

Wearing with felt

In FIG. 5, the number (21) shows a photosensitive drum having a photosensitive layer on a substrate. The drum is attached rotatably. The number (22) shows felt. The felt is pressed against the photosensitive drum (21) and movable to be rolled up by a roller (23).

The press of felt (22) against the photosensitive drum (21) (which can be calculated on the basis of the contact area and contact pressure of felt with the drum), the revolution speed of the drum (peripheral speed (cm/sec)) and the feet rate of the felt were adjusted as shown in Table 5 to measure scraped amount. The revolving direction of the drum and the feed direction of the felt were shown in FIG. 5.

Wearing with Blade

The photosensitive layer is worn or scraped by the drum while the photosensitive drum is revolved.

The pressure is calculated as a pressure per unit length on the basis of the contact length and contact pressure of the blade with the drum. The wearing of the surface of the photosensitive layer was carried out under the pressure and the revolution speed of the drum (peripheral speed (cm/sec)) as shown in Table 5 to measure scraped amount. The drum was revolved in the direction of the arrow shown in FIG. 6.

TABLE 5

| Example No. | organic photosensitive layer | treatment | apparatus | procedure |
|---|---|---|---|---|
| 91 | (a) | wearing with felt | FIG. 5 | pressure 10 g/cm$^2$: peripheral speed of drum 10 cm/sec feed rate of felt 10 cm/min:10 sec |
| 92 | " | " | " | pressure 10 g/cm$^2$: peripheral speed of drum 10 cm/sec: feed rate of felt 10 cm/min:30 sec |
| 93 | " | " | " | pressure 10 g/cm$^2$: peripheral speed of drum 10 cm/sec: feed rate of felt 10 cm/min:1 min |
| 94 | " | " | " | pressure 30 g/cm$^2$: peripheral speed of drum 10 cm/sec: feed rate of felt 10 cm/min:10 sec |
| 95 | " | " | " | pressure 30 g/cm$^2$: peripheral speed of drum 10 cm/sec: feed rate of felt 10 cm/min:30 sec |
| 96 | " | " | " | pressure 30 g/cm$^2$: peripheral speed of drum 10 cm/sec: feed rate of felt 10 cm/min:1 min |
| 97 | " | " | " | pressure 30 g/cm$^2$: peripheral speed of drum 30 cm/sec: feed rate of felt 10 cm/min:10 sec |
| 98 | " | " | " | pressure 30 g/cm$^2$: peripheral speed of drum 30 cm/sec: feed rate of felt 10 cm/min:30 sec |
| 99 | " | " | " | pressure 30 g/cm$^2$: peripheral speed of drum 30 cm/sec: feed rate of felt 10 cm/min:1 min |
| 100 | " | " | " | pressure 50 g/cm$^2$: peripheral speed of drum 50 cm/min: feed rate of felt 10 cm/min:10 min |
| 101 | " | " | " | pressure 50 g/cm$^2$: peripheral speed of drum 50 cm/min: feed rate of felt 10 cm/min:20 min |
| 102 | (a) | wearing with blade | FIG. 6 | pressure 300 g/cm: peripheral speed of drum 30 cm/sec:10 min |
| 103 | " | " | " | pressure 300 g/cm: peripheral speed of drum 30 cm/sec:30 sec |
| 104 | " | " | " | pressure 300 g/cm: peripheral speed of drum 30 cm/sec:1 min |
| 105 | " | " | " | pressure 300 g/cm: peripheral speed of drum 30 cm/sec:50 min |
| 106 | " | " | " | pressure 300 g/cm: peripheral speed of drum 30 cm/sec:100 min |
| 107 | (b) | wearing with felt | FIG. 5 | same as those in Example 96 |
| 108 | " | " | " | same as those in Example 100 |
| 109 | (c) | " | " | same as those in Example 92 |
| 110 | " | " | " | same as those in Example 100 |
| 111 | (d) | " | " | same as those in Example 92 |
| 112 | " | " | " | same as those in Example 100 |
| 113 | (e) | " | " | same as those in Example 92 |
| 114 | " | " | " | same as those in Example 100 |
| 115 | (f) | " | " | same as those in Example 92 |
| 116 | " | " | " | same as those in Example 100 |
| 117 | (a) | " | " | same as those in Example 96 |
| 118 | " | " | " | " |
| 119 | " | " | " | " |
| 120 | " | " | " | " |
| 121 | " | " | " | " |
| 122 | " | " | " | " |

In FIG. 6, the number (21) shows a photosensitive drum having a photosensitive layer on a substrate. The drum is attached rotatably. A blade made of urethane is pressed against the surface of the photosensitive drum.

Measurement of Scraped Amount

Small part of a photosensitive layer was dissolved with solvent. Then, the thickness of the photosensitive layer was measured by a roughness-measuring apparatus (SURSCOM550A; made by Tokyo Seimitsu K. K.). The thickness was measured before and after the wearing process. The scraped amount was shown as the difference of the layer thickness before and after the wearing process.

When the scraped amount was so small that the value thereof was within the range of error of measuring apparatus, it was calculated proportionally on the basis of the scraped amount obtained after longer wearing process. The results were shown in Table 5.

Formation of Surface Protective Layer

A surface protective layer was formed on the photosensitive layers (a)–(g) under the conditions shown in Table 5 in a manner similar to Example 1 after the photosensitive layers were subjected to the wearing process. The obtained photosensitive members were evaluated in a manner similar to Example 1.

The production conditions of a-C layers are summarized in Table 6.

The evaluation results are summarized in Table 7.

TABLE 6

| Example No. | organic photosensitive layer | scraped amount [Å] | preparation method of a-C layer: materal gas and flom rate [sccm] gas | gas | electric power [W] | pressure [Torr] | frequency [KHz] | sub-strate [°C.] | layer formation time [sec] | layer thickness [Å] |
|---|---|---|---|---|---|---|---|---|---|---|
| 91 | (a) | 30 | | | same as those in Example 1 | | | | | |
| 92 | " | 90 | | | | " | | | | |
| 93 | " | 180 | | | | " | | | | |
| 94 | " | 60 | | | | " | | | | |
| 95 | " | 180 | | | | " | | | | |
| 96 | " | 360 | | | | " | | | | |
| 97 | " | 100 | | | | " | | | | |
| 98 | " | 200 | | | | " | | | | |
| 99 | " | 400 | | | | " | | | | |
| 100 | " | 10000 | | | | " | | | | |
| 101 | " | 20000 | | | | " | | | | |
| 102 | " | 40 | | | | " | | | | |
| 103 | " | 80 | | | | " | | | | |
| 104 | " | 160 | | | | " | | | | |
| 105 | " | 8000 | | | | " | | | | |
| 106 | " | 16000 | | | | " | | | | |
| 107 | (b) | 120 | | | | " | | | | |
| 108 | " | 4000 | | | | " | | | | |
| 109 | (c) | 90 | | | | " | | | | |
| 110 | " | 10000 | | | | " | | | | |
| 111 | (d) | 90 | | | | " | | | | |
| 112 | " | 10000 | | | | " | | | | |
| 113 | (e) | 90 | | | | " | | | | |
| 114 | " | 10000 | | | | " | | | | |
| 115 | (f) | 90 | | | | " | | | | |
| 116 | " | 10000 | | | | " | | | | |
| 117 | (a) | 360 | helium:300 | butadiene:30 | 180 | 0.5 | 100 | 50 | 250 | 1200 |
| 118 | " | " | hydrogen:300 | propylene:30 | " | " | " | " | 240 | " |
| 119 | " | " | " | butadiene:30 | 360 | " | " | " | 115 | " |
| 120 | " | " | " | " | 180 | 1 | " | " | 200 | " |
| 121 | " | " | " | " | " | 0.5 | * | " | 280 | " |
| 122 | " | " | " | " | " | " | 100 | 30 | 180 | " |

*13.56 MHz

TABLE 7

| Example No. | organic photosensitive layer | evaluation: Vo afer coated upper | middle | lower | Vo uniformity circumferential direction upper | middle | lower | longer direction | adhesivity drum upper | middle | lower | images copied |
|---|---|---|---|---|---|---|---|---|---|---|---|---|
| 91 | (a) | ○ | ○ | ○ | ○ | ○ | ○ | ○ | Δ | Δ | Δ | ○ |
| 92 | " | ○ | ○ | ○ | ○ | ○ | ○ | ○ | ○ | ○ | ○ | ○ |
| 93 | " | ○ | ○ | ○ | ○ | ○ | ○ | ○ | ○ | ○ | ○ | ○ |
| 94 | " | ○ | ○ | ○ | ○ | ○ | ○ | ○ | Δ | Δ | Δ | ○ |
| 95 | " | ○ | ○ | ○ | ○ | ○ | ○ | ○ | ○ | ○ | ○ | ○ |
| 96 | " | ○ | ○ | ○ | ○ | ○ | ○ | ○ | ○ | ○ | ○ | ○ |
| 97 | " | ○ | ○ | ○ | ○ | ○ | ○ | ○ | ○ | ○ | ○ | ○ |
| 98 | " | ○ | ○ | ○ | ○ | ○ | ○ | ○ | ○ | ○ | ○ | ○ |
| 99 | " | ○ | ○ | ○ | ○ | ○ | ○ | ○ | ○ | ○ | ○ | ○ |
| 100 | " | ○ | ○ | ○ | ○ | ○ | ○ | ○ | ○ | ○ | ○ | ○ |
| 101 | " | Δ | Δ | Δ | ○ | ○ | ○ | ○ | ○ | ○ | ○ | ○ |
| 102 | " | ○ | ○ | ○ | ○ | ○ | ○ | ○ | Δ | Δ | Δ | ○ |
| 103 | " | ○ | ○ | ○ | ○ | ○ | ○ | ○ | ○ | ○ | ○ | ○ |
| 104 | " | ○ | ○ | ○ | ○ | ○ | ○ | ○ | ○ | ○ | ○ | ○ |
| 105 | " | ○ | ○ | ○ | ○ | ○ | ○ | ○ | ○ | ○ | ○ | ○ |
| 106 | " | Δ | Δ | Δ | ○ | ○ | ○ | ○ | ○ | ○ | ○ | ○ |
| 107 | (b) | ○ | ○ | ○ | ○ | ○ | ○ | ○ | ○ | ○ | ○ | ○ |
| 108 | " | ○ | ○ | ○ | ○ | ○ | ○ | ○ | ○ | ○ | ○ | ○ |
| 109 | (c) | ○ | ○ | ○ | ○ | ○ | ○ | ○ | ○ | ○ | ○ | ○ |
| 110 | " | ○ | ○ | ○ | ○ | ○ | ○ | ○ | ○ | ○ | ○ | ○ |
| 111 | (d) | ○ | ○ | ○ | ○ | ○ | ○ | ○ | ○ | ○ | ○ | ○ |

TABLE 7-continued

| Example No. | organic photosensitive layer | evaluation: Vo afer coated upper | Vo afer coated middle | Vo afer coated lower | Vo uniformity circumferential direction upper | Vo uniformity circumferential direction middle | Vo uniformity circumferential direction lower | Vo uniformity longer direction | adhesivity drum upper | adhesivity drum middle | adhesivity drum lower | images copied |
|---|---|---|---|---|---|---|---|---|---|---|---|---|
| 112 | " | o | o | o | o | o | o | o | o | o | o | o |
| 113 | (e) | o | o | o | o | o | o | o | o | o | o | o |
| 114 | " | o | o | o | o | o | o | o | o | o | o | o |
| 115 | (f) | o | o | o | o | o | o | o | o | o | o | o |
| 116 | " | o | o | o | o | o | o | o | o | o | o | o |
| 117 | (a) | o | o | o | o | o | o | o | o | o | o | o |
| 118 | " | o | o | o | o | o | o | o | o | o | o | o |
| 119 | " | o | o | o | o | o | o | o | o | o | o | o |
| 120 | " | o | o | o | o | o | o | o | o | o | o | o |
| 121 | " | o | o | o | o | o | o | o | o | o | o | o |
| 122 | " | o | o | o | o | o | o | o | o | o | o | o |

In Examples 91-101, the organic photosensitive layer (a) was worn with felt under different conditions by the equipment shown in FIG. 1. The photosensitive layer was worn to various level of scraped amount.

When the scraped amount was small (in Examples 91 and 94), the adhesivity was a little poor, but there was no practical problem. When compared with Comparative Examples 1-6, the present invention exhibited much better properties. When the scraped amount was large (in Example 101), the initial surface potential decreased a little, however, there was no practical use, and satisfactory results were obtained.

When the scraped amount was within the range of 90 Å-1 μm, there was no problem, and satisfactory results were obtained (in Examples 92, 93, 95, 96, 97, 98, 99 and 100).

In Examples 102-106, the photosensitive layers were worn with blade under different conditions by the equipment shown in FIG. 6. The obtained results were as satisfactory as those in Examples 91-101.

Examples 107-116 shows that the present invention could be applied to photosensitive layers other than the photosensitive layer (a). The obtained results were as satisfactory as those in Examples 91-101.

Surface Protective Layer of $Al_2O_3$

Further, a photosensitive member was prepared and evaluated in a manner similar to Example 91, except that thin layer of $Al_2O_3$ was formed as a surface protective layer instead of an a-C layer in the same manner as described above.

The obtained results were as satisfactory as those in Example 91.

Surface Protective Layer of SiO

Further, a photosensitive member was prepared and evaluated in a manner similar to Example 91, except that thin layer of SiO was formed as a surface protective layer instead of an a-C layer in the same manner as described above.

The obtained results were as satisfactory as those in Example 91.

It is understood that the present invention can be applied to the preparation of a photosensitive member having a thin layer deposited under vacuum conditions as a surface protective layer, not being restricted to a photosensitive member having an a-C layer as a surface protective layer.

Preparation of Photosensitive Layer (h) of Amorphous Silicon

An undercoat layer of a-Si:C type and a photosensitive layer of a-Si type were formed on a cylindrical aluminum substrate of 80 mm in diameter×340 mm in length by a usual plasma-CVD equipment. The conditions for the layer formation were as follows;

(i) undercoat layer of a-Si:C type
Material gas $SiH_4$:120 sccm
and
Gas flow rate
$H_2$:600 sccm
$C_2H_2$:60 sccm
$B_2H_6$:30 sccm
(diluted to 1000 ppm with hydrogen)
Distance between Substrate and Electrode:40 ram
Frequency of Electric
Power Supply:13.56 MHz
Discharge Power:250 W
Degree of Vacuum:0.8 Torr
Temperature of Substrate:200° C.
Discharge Time:2 minutes
Layer Thickness:2500 Å
Composition:
Si:about 42 atomic %
C:about 36 atomic %
H:about 22 atomic %
B:about 230 atomic ppm (ii) photosensitive layer of a-Si type
Material gas $SiH_4$:180 sccm
and
Gas flow rate
$H_2$:600 sccm
$O_2$:0.4 sccm
$B_2H_6$:3 sccm
(diluted to 100 ppm with hydrogen)
Distance between Substrate and Electrode:40 mm
Frequency of Electric
Power Supply:13.56 MHz
Discharge Power:300 W
Degree of Vacuum:1.0 Torr
Temperature of Substrate:200° C.
Discharge Time:4 hours
Layer Thickness:23 μm
Composition:
Si:about 79 atomic %
H:about 21 atomic %
O:about 0.16 atomic %
B:about 17 atomic ppm Preparation of Photosensitive Layer (i) of Amorphous Selenium type A photosensitive layer of $As_2Se_3$ type was formed on a cylindrical aluminum substrate of 80 mm in diameter×340 mm in length by a usual deposition apparatus of electrical resistance heating type.

The pressure at layer formation was $2\times10^{-6}$ Torr. The deposition rate was 30 Å/sec. The thickness of the formed photosensitive layer was 50 μm.

Bombarding treatment and Formation of Surface Protective Layer

The photosensitive layers (a), (h) and (i) were subjected to a bombarding treatment as described below after kept at 20° C. in temperature and 65% in humidity for 30 days. Then, a surface protective layer was formed on the photosensitive layer.

The photosensitive layer (a) was set in a usual P-CVD apparatus. The apparatus inside was vacuumized to about $10^{-5}$ Torr. Then, the pressure inside the apparatus was adjusted to 0.2 Torr as argon gas was introduced into the apparatus at the rate of 100 sccm. When the pressure became constant, the electrode was provided with electric power of low frequency (150 W, 80 KHz) to generate plasma of Ar for the bombarding treatment. The bombarding treatment was carried out for 1 minute. At this time, the temperature of the substrate was kept at 50° C.

After the bombarding treatment, the photosensitive layer was once taken out of vacuum system. Then, an amorphous carbon layer was formed on the photosensitive layer as a surface protective layer in a usual P-CVD apparatus as described below. The surface protective layer began to be formed within 3 hours after the bombarding treatment ended.

The photosensitive layer (a), which was bombard-treated, was set in the P-CVD apparatus. The apparatus inside was vacuumized to about $10^{-5}$ Torr. Then, the pressure inside the apparatus was adjusted to 0.3 Torr as hydrogen gas and butadiene gas were introduced into the apparatus at the rate of 300 sccm and 30 sccm respectively. When the pressure became constant, the electrode was provided with electric power of low frequency (150 W, 80 KHz) to form an a-C layer for 3 minutes. At this time, the temperature of the substrate was kept at 50° C. The obtained a-C layer had the layer thickness of 0.96 μm.

The conditions of the bombarding treatment and the formation of the surface protective layer were summarized in Table 8.

The photosensitive layers (h) and (i) were subjected to a bombarding treatment and a surface protective layer was formed as described above. The conditions of the bombarding treatment and the formation of the surface protective layer were summarized in Table 8.

In Table 8, photosensitive members having thin layer of $Al_2O_3$ or SiO as a surface protective layer were also shown. The thin layer of $Al_2O_3$ or SiO was prepared in the same manner as described above.

The results of evaluation were also summarized in Table 9.

TABLE 8

| Example No. | organic photosensitive layer | pretreatment conditions | | overcoating conditions |
|---|---|---|---|---|
| 123 | (a) | Ar: 100 sccm: 0.2 Torr: 50° C.: 80 KHz: 150 W: | 1 min | a-C layer prepared by P-CVD method |
| 124 | " | Ar: 100 sccm: 0.2 Torr: 50° C.: 80 KHz: 150 W: | 2 min | $H_2$: 300 sccm + butadiene: 30 sccm |
| 125 | " | Ar: 100 sccm: 0.2 Torr: 50° C.: 80 KHz: 150 W: | 5 min | 0.3 Torr: 50° C.: 80 KHz: 150 W: |
| 126 | " | Ar: 100 sccm: 0.2 Torr: 50° C.: 80 KHz: 150 W: | 10 min | 3 min: layer thickness 0.96 μm |
| 127 | (a) | Ar: 100 sccm: 0.2 Torr: 50° C.: 80 KHz: 20 W: | 5 min | a-C layer prepared by P-CVD method |
| 128 | " | Ar: 100 sccm: 0.2 Torr: 50° C.: 80 KHz: 100 W: | 5 min | $H_2$: 300 sccm + butadiene: 30 sccm |
| 129 | " | Ar: 100 sccm: 0.2 Torr: 50° C.: 80 KHz: 200 W: | 5 min | 0.3 Torr: 50° C.: 80 KHz: 150 W: 3 min: layer thickness 0.96 μm |
| 130 | (a) | Ar: 100 sccm: 0.2 Torr: 50° C.: * 150 W: | 5 min | *13.56 MHz |
| 131 | " | Ar: 100 sccm: 0.2 Torr: 50° C. 1 KHz: 150 W: | 5 min | a-C layer prepared by P-CVD method |
| 132 | " | Ar: 100 sccm: 0.2 Torr: 50° C.: 30 KHz: 150 W: | 5 min | $H_2$: 300 sccm + butadiene: 30 sccm 0.3 Torr: 50° C.: 80 KHz: 150 W: 3 min: layer thickness 0.96 μm |
| 133 | (a) | Ar: 100 sccm: 2.0 Torr: 50° C.: 80 KHz: 150 W | 5 min | a-C layer prepared by P-CVD method |
| 134 | " | Ar: 100 sccm: 1.0 Torr: 50° C.: 80 KHz: 150 W: | | $H_2$: 300 sccm + butadiene: 30 sccm |
| 135 | " | Ar: 100 sccm: 0.1 Torr: 50° C.: 80 KHz: 150 W: | | 0.3 Torr: 50° C.: 80 KHz: 150 W: 3 min: layer thickness 0.96 μm |
| 136 | (a) | Hc: 100 sccm: 0.2 Torr: 50° C.: 80 KHz: 150 W: | 1 min | a-C layer prepared by P-CVD method |
| 137 | " | Hc: 100 sccm: 0.2 Torr: 50° C.: 80 KHz: 150 W: | 2 min | $H_2$: 300 sccm + butadiene: 30 sccm |
| 138 | " | Hc: 100 sccm: 0.2 Torr: 50° C.: 80 KHz: 150 W: | 5 min | 0.3 Torr: 50° C.: 80 KHz: 150 W: |
| 139 | " | Hc: 100 sccm: 0.2 Torr: 50° C.: 80 KHz: 150 W: | 10 min | 3 min: layer thickness 0.96 μm |
| 140 | (a) | $N_2$: 100 sccm: 0.2 Torr: 50° C.: 80 KHz: 150 W: | 1 min | a-C layer prepared by P-CVD method |
| 141 | " | $N_2$: 100 sccm: 0.2 Torr: 50° C.: 80 KHz: 150 W: | 2 min | $H_2$: 300 sccm + butadiene: 30 sccm |
| 142 | " | $N_2$: 100 sccm: 0.2 Torr: 50° C.: 80 KHz: 150 W: | 5 min | 0.3 Torr: 50° C.: 80 KHz: 150 W: |
| 143 | " | $N_2$: 100 sccm: 0.2 Torr: 50° C.: 80 KHz: 150 W: | 10 min | 3 min: layer thickness 0.96 μm |
| 144 | (a) | $O_2$: 100 sccm: 0.2 Torr: 50° C.: 80 KHz: 150 W: | 1 min | a-C layer prepared by P-CVD method |
| 145 | " | $O_2$: 100 sccm: 0.2 Torr: 50° C.: 80 KHz: 150 W: | 2 min | $H_2$: 300 sccm + butadiene: 30 sccm |
| 146 | " | $O_2$: 100 sccm: 0.2 Torr: 50° C.: 80 KHz: 150 W: | 5 min | 0.3 Torr: 50° C.: 80 KHz: 150 W: |
| 147 | " | $O_2$: 100 sccm: 0.2 Torr: 50° C.: 80 KHz: 150 W: | 10 min | 3 min: layer thickness 0.96 μm |
| 148 | (h) | Ar: 100 sccm: 0.2 Torr: 50 ° C.: 80 KHz: 150 W: | 1 min | a-C layer prepared by P-CVD method |
| 149 | " | Ar: 100 sccm: 0.2 Torr: 50 ° C.: 80 KHz: 150 W: | 2 min | $H_2$: 300 sccm + butadiene: 30 sccm |
| 150 | " | Ar: 100 sccm: 0.2 Torr: 50 ° C.: 80 KHz: 150 W: | 5 min | 0.3 Torr: 50° C.: 80 KHz: 150 W: |
| 151 | " | Ar: 100 sccm: 0.2 Torr: 50 ° C.: 80 KHz: 150 W: | 10 min | 3 min: layer thickness 0.96 μm |
| 152 | (h) | Ar: 100 sccm: 0.2 Torr: 20° C.: 80 KHz: 150 W: | 5 min | a-C layer prepared by P-CVD method |
| 153 | " | Ar: 100 sccm: 0.2 Torr: 100° C.: 80 KHz: 150 W: | | $H_2$: 300 sccm + butadiene: 30 sccm |
| 154 | " | Ar: 100 sccm: 0.2 Torr: 200° C.: 80 KHz: 150 W: | | 0.3 Torr: 50° C.: 80 KHz: 150 W: 3 min: layer thickness 0.96 μm |
| 155 | (i) | Ar: 100 sccm: 0.2 Torr: 50° C.: 80 KHz: 150 W: | 1 min | a-C layer prepared by P-CVD method |
| 156 | " | Ar: 100 sccm: 0.2 Torr: 50° C.: 80 KHz: 150 W: | 2 min | $H_2$: 300 sccm + butadiene: 30 sccm |
| 157 | " | Ar: 100 sccm: 0.2 Torr: 50° C.: 80 KHz: 150 W: | 5 min | 0.3 Torr: 50° C.: 80 KHz: 150 W: |

TABLE 8-continued

| Example No. | organic photosensitive layer | pretreatment conditions | | overcoating conditions |
|---|---|---|---|---|
| 158 | " | Ar: 100 sccm: 0.2 Torr: 50° C.: 80 KHz: 150 W: | 10 min | 3 min: layer thickness 0.96 μm |
| 159 | (a) | Ar: 100 sccm: 0.2 Torr: 50° C.: 80 KHz: 150 W: | 1 min | a-C layer prepared by P-CVD method |
| 160 | " | Ar: 100 sccm: 0.2 Torr: 50° C.: 80 KHz: 150 W: | 2 min | $H_2$: 300 sccm + butadiene: 30 sccm |
| 161 | " | Ar: 100 sccm: 0.2 Torr: 50° C.: 80 KHz: 150 W: | 5 min | 0.3 Torr: 50° C.: 80 KHz: 150 W: |
| 162 | " | Ar: 100 sccm: 0.2 Torr: 50° C.: 80 KHz: 150 W: | 10 min | 3 min: layer thickness 0.96 μm |
| 163 | (a) | Ar: 100 sccm: 0.2 Torr: 50° C.: 80 KHz: 150 W: | 1 min | $Al_2O_3$ layer prepared by sputtering |
| 164 | " | Ar: 100 sccm: 0.2 Torr: 50° C.: 80 KHz: 150 W: | 2 min | method |
| 165 | " | Ar: 100 sccm: 0.2 Torr: 50° C.: 80 KHz: 150 W: | 5 min | |
| 166 | " | Ar: 100 sccm: 0.2 Torr: 50° C.: 80 KHz: 150 W: | 10 min | |
| 167 | (a) | Ar: 100 sccm: 0.2 Torr: 50° C.: 80 KHz: 150 W: | 1 min | SiO layer prepared by depositing method |
| 168 | " | Ar: 100 sccm: 0.2 Torr: 50° C.: 80 KHz: 150 W: | 2 min | |
| 169 | " | Ar: 100 sccm: 0.2 Torr: 50° C.: 80 KHz: 150 W: | 5 min | |
| 170 | " | Ar: 100 sccm: 0.2 Torr: 50° C.: 80 KHz: 150 W: | 10 min | |
| 171 | (a) | $O_2$: 100 sccm: 0.2 Torr: 50° C.: 80 KHz: 150 W: | 1 min | same as those in Example 163 |
| 172 | " | $O_2$: 100 sccm: 0.2 Torr: 50° C.: 80 KHz: 150 W: | | same as those in Example 167 |
| 173 | (h) | $O_2$: 100 sccm: 0.2 Torr: 50° C.: 80 KHz: 150 W: | | same as those in Example 163 |
| 174 | " | $O_2$: 100 sccm: 0.2 Torr: 50° C.: 80 KHz: 150 W: | | same as those in Example 167 |
| 175 | (i) | $O_2$: 100 sccm: 0.2 Torr: 50° C.: 80 KHz: 150 W: | | same as those in Example 163 |
| 176 | " | $O_2$: 100 sccm: 0.2 Torr: 50° C.: 80 KHz: 150 W: | | same as those in Example 167 |
| Comparative Example | | | | |
| 7 | (h) | no pretreatment | | same as those in Example 123 |
| 8 | " | " | | same as those in Example 163 |
| 9 | " | " | | same as those in Example 167 |
| 10 | (i) | " | | same as those in Example 123 |
| 11 | " | " | | same as those in Example 163 |
| 12 | " | " | | same as those in Example 167 |

TABLE 9

| Example No. | organic photosensitive layer | $V_0$ after coated | | | $V_0$ uniformity circumferential direction | | | longer direction | adhesivity drum | | | images copied |
|---|---|---|---|---|---|---|---|---|---|---|---|---|
| | | upper | middle | lower | upper | middle | lower | | upper | middle | lower | |
| 123 | (a) | ○ | ○ | ○ | ○ | ○ | ○ | ○ | △ | △ | △ | △ |
| 124 | " | ○ | ○ | ○ | ○ | ○ | ○ | ○ | ○ | ○ | ○ | ○ |
| 125 | " | ○ | ○ | ○ | ○ | ○ | ○ | ○ | ○ | ○ | ○ | ○ |
| 126 | " | ○ | ○ | ○ | ○ | ○ | ○ | ○ | ○ | ○ | ○ | ○ |
| 127 | (a) | ○ | ○ | ○ | ○ | ○ | ○ | ○ | △ | △ | △ | △ |
| 128 | " | ○ | ○ | ○ | ○ | ○ | ○ | ○ | ○ | ○ | ○ | ○ |
| 129 | " | ○ | ○ | ○ | ○ | ○ | ○ | ○ | ○ | ○ | ○ | ○ |
| 130 | (a) | ○ | ○ | ○ | ○ | ○ | ○ | ○ | △ | △ | △ | △ |
| 131 | " | ○ | ○ | ○ | ○ | ○ | ○ | ○ | ○ | ○ | ○ | ○ |
| 132 | " | ○ | ○ | ○ | ○ | ○ | ○ | ○ | ○ | ○ | ○ | ○ |
| 133 | (a) | ○ | ○ | ○ | ○ | ○ | ○ | ○ | △ | △ | △ | △ |
| 134 | " | ○ | ○ | ○ | ○ | ○ | ○ | ○ | ○ | ○ | ○ | ○ |
| 135 | ○ | ○ | ○ | ○ | ○ | ○ | ○ | ○ | ○ | ○ | ○ | |
| 136 | (a) | ○ | ○ | ○ | ○ | ○ | ○ | ○ | △ | △ | △ | △ |
| 137 | " | ○ | ○ | ○ | ○ | ○ | ○ | ○ | ○ | ○ | ○ | ○ |
| 138 | " | ○ | ○ | ○ | ○ | ○ | ○ | ○ | ○ | ○ | ○ | ○ |
| 139 | " | ○ | ○ | ○ | ○ | ○ | ○ | ○ | ○ | ○ | ○ | ○ |
| 140 | (a) | ○ | ○ | ○ | ○ | ○ | ○ | ○ | △ | △ | △ | △ |
| 141 | " | ○ | ○ | ○ | ○ | ○ | ○ | ○ | ○ | ○ | ○ | ○ |
| 142 | " | ○ | ○ | ○ | ○ | ○ | ○ | ○ | ○ | ○ | ○ | ○ |
| 143 | " | ○ | ○ | ○ | ○ | ○ | ○ | ○ | ○ | ○ | ○ | ○ |
| 144 | (a) | ○ | ○ | ○ | ○ | ○ | ○ | ○ | ○ | ○ | ○ | ○ |
| 145 | " | ○ | ○ | ○ | ○ | ○ | ○ | ○ | ○ | ○ | ○ | ○ |
| 146 | " | ○ | ○ | ○ | ○ | ○ | ○ | ○ | ○ | ○ | ○ | ○ |
| 147 | " | ○ | ○ | ○ | ○ | ○ | ○ | ○ | ○ | ○ | ○ | ○ |
| 148 | (h) | ○ | ○ | ○ | ○ | ○ | ○ | ○ | △ | △ | △ | △ |
| 149 | " | ○ | ○ | ○ | ○ | ○ | ○ | ○ | ○ | ○ | ○ | ○ |
| 150 | " | ○ | ○ | ○ | ○ | ○ | ○ | ○ | ○ | ○ | ○ | ○ |
| 151 | " | ○ | ○ | ○ | ○ | ○ | ○ | ○ | ○ | ○ | ○ | ○ |
| 152 | (h) | ○ | ○ | ○ | ○ | ○ | ○ | ○ | △ | △ | △ | △ |
| 153 | " | ○ | ○ | ○ | ○ | ○ | ○ | ○ | ○ | ○ | ○ | ○ |
| 154 | " | ○ | ○ | ○ | ○ | ○ | ○ | ○ | ○ | ○ | ○ | ○ |
| 155 | (i) | ○ | ○ | ○ | ○ | ○ | ○ | ○ | △ | △ | △ | △ |
| 156 | " | ○ | ○ | ○ | ○ | ○ | ○ | ○ | ○ | ○ | ○ | ○ |
| 157 | " | ○ | ○ | ○ | ○ | ○ | ○ | ○ | ○ | ○ | ○ | ○ |
| 158 | " | ○ | ○ | ○ | ○ | ○ | ○ | ○ | ○ | ○ | ○ | ○ |
| 159 | (a) | ○ | ○ | ○ | ○ | ○ | ○ | ○ | △ | △ | △ | △ |
| 160 | " | ○ | ○ | ○ | ○ | ○ | ○ | ○ | ○ | ○ | ○ | ○ |
| 161 | " | ○ | ○ | ○ | ○ | ○ | ○ | ○ | ○ | ○ | ○ | ○ |
| 162 | " | ○ | ○ | ○ | ○ | ○ | ○ | ○ | ○ | ○ | ○ | ○ |
| 163 | (a) | ○ | ○ | ○ | ○ | ○ | ○ | ○ | △ | △ | △ | △ |
| 164 | " | ○ | ○ | ○ | ○ | ○ | ○ | ○ | ○ | ○ | ○ | ○ |
| 165 | " | ○ | ○ | ○ | ○ | ○ | ○ | ○ | ○ | ○ | ○ | ○ |
| 166 | " | ○ | ○ | ○ | ○ | ○ | ○ | ○ | ○ | ○ | ○ | ○ |

TABLE 9-continued

| Example No. | organic photosensitive layer | $V_0$ after coated | | | $V_0$ uniformity circumferential direction | | | $V_0$ uniformity longer direction | adhesivity drum | | | images copied |
|---|---|---|---|---|---|---|---|---|---|---|---|---|
| | | upper | middle | lower | upper | middle | lower | | upper | middle | lower | |
| 167 | (a) | ○ | ○ | ○ | ○ | ○ | ○ | ○ | Δ | Δ | Δ | Δ |
| 168 | " | ○ | ○ | ○ | ○ | ○ | ○ | ○ | ○ | ○ | ○ | ○ |
| 169 | " | ○ | ○ | ○ | ○ | ○ | ○ | ○ | ○ | ○ | ○ | ○ |
| 170 | " | ○ | ○ | ○ | ○ | ○ | ○ | ○ | ○ | ○ | ○ | ○ |
| 171 | (a) | ○ | ○ | ○ | ○ | ○ | ○ | ○ | ○ | ○ | ○ | ○ |
| 172 | " | ○ | ○ | ○ | ○ | ○ | ○ | ○ | ○ | ○ | ○ | ○ |
| 173 | (h) | ○ | ○ | ○ | ○ | ○ | ○ | ○ | Δ | Δ | Δ | Δ |
| 174 | " | ○ | ○ | ○ | ○ | ○ | ○ | ○ | Δ | Δ | Δ | Δ |
| 175 | (i) | ○ | ○ | ○ | ○ | ○ | ○ | ○ | Δ | Δ | Δ | Δ |
| 176 | " | ○ | ○ | ○ | ○ | ○ | ○ | ○ | Δ | Δ | Δ | Δ |
| Comparative Example | | | | | | | | | | | | |
| 7 | (h) | ○ | ○ | ○ | Δ | Δ | Δ | Δ | x | x | x | x |
| 8 | " | ○ | ○ | ○ | Δ | Δ | Δ | Δ | x | x | x | x |
| 9 | " | ○ | ○ | ○ | Δ | Δ | Δ | Δ | x | x | x | x |
| 10 | (i) | ○ | ○ | ○ | Δ | Δ | Δ | Δ | x | x | x | x |
| 11 | " | ○ | ○ | ○ | Δ | Δ | Δ | Δ | x | x | x | x |
| 12 | " | ○ | ○ | ○ | Δ | Δ | Δ | Δ | x | x | x | x |

In Examples 123–135, the photosensitive layer (a) was subjected to a bombarding treatment with argon under different conditions and then, an a-C layer was formed by a plasma-CVD method.

In Examples 152–154, the photosensitive layer (h) of amorphous silicon type was subjected to a bombarding treatment at different temperature of substrate.

It is understood from the results of Examples 123–135 and Examples 152–154 that the adhesivity of the a-C layer to the photosensitive layer is achieved without deterioration of electrostatic properties.

The adhesivity is a little poor when the bombarding time is shorter than 2 minutes (compare Example 123 with Example 124), when the bombarding power is lower than 100 W (compare Example 127 with Example 128), when the bombarding frequency is higher than 1 MHz (compare Example 130 with Example 131), when the bombarding pressure is higher than 1 Torr (compare Example 133 with Example 134) and when the substrate temperature is lower than 50° C. (compare Example 152 with Example 125). However, there is no problem in practical use. Examples 123–135 and 152–154 prove that bombarding treatment is effective elements to achieve the objects of the present invention when compared with Comparative Examples 1–12.

It is understood from Examples 136–147 that when herium gas, oxygen gas, nitrogen gas and the like were used as a gas for bombarding treatment, the same results as those of argon gas were obtained. In particular, when the photosensitive layer was bombarded with oxygen gas in Example 144, the adhesivity is much better than that obtained in Examples 123, 136 and 140 in which the bombarding conditions are the same as those of Example 144 except for the kind of a gas for bombardment.

It is understood from Examples 148–151, 155–158 that inorganic photosensitive layers can be bombarded to exhibit the same results as those of the organic photosensitive layer in Example 123.

When the a-C layers, the $Al_2O_3$ layers and the SiO layers are formed under different conditions as a surface protective layer as shown in Examples 159–170, the same results as those in Example 123 were obtained.

It is also understood that the excellent adhesivity is obtained.

The bombarding treatment of the organic photosensitive layer with oxygen gas gives the same excellent adhesivity to the photosensitive members having a surface protective layer other than an a-C layer as shown in Examples 171–176.

Washing of Photosensitive Layer (g) with Vapor

Figure 7:
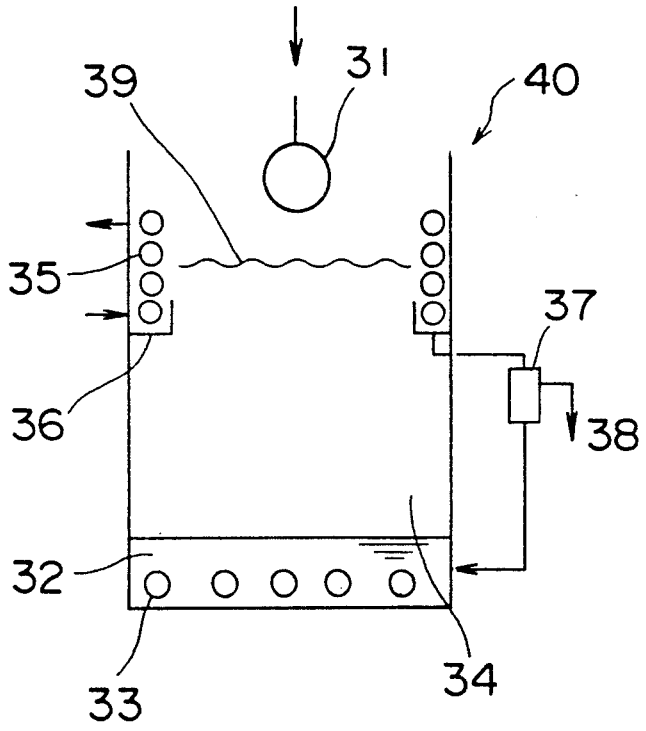
FIG. 7 shows a schematic washing method with vapor.

The photosensitive layer (g) was kept for 1 week and then washed with vapor by an equipment shown in FIG. 7.

In FIG. 7, the number (31) is the photosensitive member having the photosensitive layer (g) on the substrate. The photosensitive member is joined to a means which is hydraulically operated (not shown) and able to move up and down. The number (40) is a washing bath. The washing bath is equipped with a heater (33) and contains a solvent for washing at the bottom. The solvent (32) is boiled by the heater (33) and a vapor phase (34) of the solvent was formed. The number (39) is the interface between the air phase and vapor phase (34). The washing bath (40) is equipped with a condensing pipe at the upper portion to liquefy the vapor of the solvent. The condensate drops to a condensate pan (36) and is returned to the washing bath through a condenser (37).

The washing with vapor was carried out as follows. The photosensitive member (31) was lowered gradually by the hydraulically operated means until the whole photosensitive member (31) was kept in the vapor phase (34) of the solvent.

While the temperature of the photosensitive member was lower than that of the vapor, the vapor was condensed and liquefied to form droplets on the surface of the photosensitive member because of the difference of the temperature between the photosensitive member and the vapor. The surface of the photosensitive member was washed out with the droplets. As the temperature of the photosensitive member increased, the vapor came not to be liquefied on the surface under equilibrium conditions. When the photosensitive member was lifted under the equilibrium conditions, a drying process was not needed and there did not arise no problem caused by nonuniform drying.

In embodiment, the photosensitive layers were washed under conditions shown in Table 10 (temperature of photosensitive layer, solvent for washing, washing time).

Formation of Surface Protective Layer

After the photosensitive layer (g) was washed in vapor phase, a surface protective layer was formed on the surface of the photosensitive layer (g) as follows.

An amorphous carbon layer (a-C layer) was formed as a surface protective layer with the glow-discharge decomposition equipment shown in FIG. 2 under the conditions below;

used gas:
hydrogen 300 sccm
butadiene 10 sccm
tetrafluorocarbon 10 sccm
layer-forming conditions:
pressure 0.2 Torr
electric source:
power supply of low frequency
frequency:30 KHz
electric power:350 W
substrate temperature:50° C.
layer-forming time:10 minutes
layer-thickness:1000 Å

Formation of Surface Protective Layer ($Si_3N_4$:$SiO_2$ =95:5

A surface protective layer composed of $SiN_4$ and $SiO_2$ (95:5) was formed on the surface protective layer (g) instead of an a-C layer by a usual sputtering equipment under the conditions below;

degree of vacuum:0.1 Torr
gas for discharge:Ar
frequency for discharge:13.56 MHz
layer thickness:0.2 μm.

Measurement of Surface Potential of Photosensitive Member (Copying machine for evaluation)

A copying machine EP490Z (made by Minolta Camera K. K.) was used.

A charger of Scorotoron type was used as a main charger.

(Measurement of Potential)

A surface Potentiometer MODEL 344 (made by TREK K. K.) was used. A probe was set to measure surface potential of the photosensitive member.

Durability test with respect to copy

A chart having 6% of B/W ratio was copied on paper of A4 size in direction of traverse under surrounding conditions by use of EP490Z for durability test with respect to copy.

The corona voltage of the main charger was adjusted to −6.0 KV before the durability test began.

Evaluation of adhesivity

Scotch® mending tape (CAT. NO. 810-1-18, tape width of 18 mm; made by Sumitomo Three M K. K.) was applied in longer direction onto a developing region (297 mm in length) of a photosensitive member having a surface protective layer, and then the tape was torn off. When leaves of surface protective layer were adhered to the adhesive face, the ratio of area where the leaves of surface protective layers were adhered to the whole tape area of the developing region (18 mm×297 mm) was calculated to rank the adhesivity.

ratio less than 1%:o
1%–less than 10%:Δ
10% or more:x

Conditions and Results

In Examples 177–181, the photosensitive layer (g) was formed on an aluminum substrate. However, the thickness of substrate was different in each Example in order to evaluate washing effects depending on "heat capacity per unit area of surface".

In Examples 182–185, photosensitive layer (g) was formed on a substrate other than aluminum as shown in Table 10 in order to evaluate the washing effects depending on heat capacity per unit area of surface.

The capacity per unit area of surface "H" is represented by the following formula:

$$H[erg \cdot K^{-1} \cdot cm^{-2}] = C[erg \cdot K^{-1} \cdot g^{-1}] \cdot D[g \cdot cm^{-3}] \cdot d[cm]$$

in which

C is specific heat,
D is density and
d is thickness.

The photosensitive members thus obtained were evaluated on adhesivity, initial surface potential ($V_0$), uniformity of initial surface potential in circumferential direction, surface potential ($V_0$) after 10000 times of copy. The obtained results are shown in Table 11.

TABLE 10

| Example No | photo-sensitive layer | substrate material | substrate thickness [mm] | substrate heat capacity per unit area of surface[H] [J · K$^{-1}$ cm$^{-2}$] | substrate temperature Ts [°C.] | solvent for washing kind | solvent for washing boiling point Tb [° C.] | washing time t [sec] | over-coat |
|---|---|---|---|---|---|---|---|---|---|
| Example 177 | g | Al | 0.5 | 0.059 | 15 | $CCl_2$ $FCCl$ $F_2$ 1,1,2-trichloro-1,2,2-trifluoro-ethane (flon-113) | 47.6 | 8 | a |
| Example 178 | g | Al | 1 | 0.118 | 22 | $CCl_2$ $FCCl$ $F_2$ 1,1,2-trichloro-1,2,2-trifluoro-ethane (flon-113) | " | 23 | a |
| Example 179 | g | Al | 2 | 0.236 | 30 | $CCl_2$ $FCCl$ $F_2$ 1,1,2-trichloro-1,2,2-trifluoro-ethane (flon-113) | " | 33 | a |
| Example 180 | g | Al | 3 | 0.354 | 22 | $CCl_2$ $FCCl$ $F_2$ 1,1,2-trichloro-1,2,2-trifluoro- | " | 23 | a |

TABLE 10-continued

| Example No | photo-sensitive layer | substrate material | substrate thickness [mm] | substrate heat capacity per unit area of surface[H] [$J \cdot K^{-1} cm^{-2}$] | substrate temperature Ts [°C.] | solvent for washing kind | solvent for washing boiling point Tb [° C.] | washing time t [sec] | over-coat |
|---|---|---|---|---|---|---|---|---|---|
| Example 181 | g | Al | 5 | 0.59 | 25 | ethane (flon-113) $CCl_2FCClF_2$ 1,1,2-trichloro-1,2,2-trifluoro-ethane (flon-113) | " | 43 | a |
| Example 182 | g | Stainless | 3 | 2.4 | 22 | $CCl_2FCClF_2$ 1,1,2-trichloro-1,2,2-trifluoro-ethane (flon-113) | " | 53 | a |
| Example 183 | g | brass (30% Zn) | 3 | 1.91 | 22 | $CCl_2FCClF_2$ 1,1,2-trichloro-1,2,2-trifluoro-ethane (flon-113) | " | 13 | a |
| Example 184 | g | Al | 2 | 0.944 | 30 | $CCl_2FCClF_2$ 1,1,2-trichloro-1,2,2-trifluoro-ethane (flon-113) | " | 33 | b |
| Example 185 | g | brass (30% Zn) | 3 | 1.91 | 22 | $CCl_2FCClF_2$ 1,1,2-trichloro-1,2,2-trifluoro-ethane (flon-113) | " | 13 | b |

TABLE 11

| Example No. | value of formula [I] [sec] | evaluation $V_0$ after 10000 times of copy [V] | initial $V_0$ [V] | noises in copied images | uniformity of $V_0$ in circumferential direction [V] | adhesivity |
|---|---|---|---|---|---|---|
| Example 177 | upper limit 15.4 lower limit 1.9 | 480 | 510 | non | 20 | ○ |
| Example 178 | upper limit 24.2 lower limit 3.0 | 430 | 460 | " | 30 | ○ |
| Example 179 | upper limit 33.2 lower limit 4.2 | 420 | 450 | " | 40 | ○ |
| Example 180 | upper limit 72.4 lower limit 9.0 | 470 | 500 | " | 20 | ○ |
| Example 181 | upper limit 107 lower limit 13.3 | 420 | 450 | " | 40 | ○ |
| Example 182 | upper limit 123 lower limit 15.4 | 410 | 440 | " | 40 | ○ |
| Example 183 | upper limit 97.6 lower limit 12.2 | 480 | 510 | " | 20 | ○ |
| Example 184 | upper limit 33.2 lower limit 4.2 | 420 | 440 | " | 40 | ○ |
| Example 185 | upper limit 97.6 lower limit 12.2 | 470 | 510 | " | 20 | ○ |

What is claimed is:

1. A production method of a photosensitive member having an organic photosensitive layer and a surface protective layer in this order on an electrically conductive substrate comprising;

a first step of forming the organic photosensitive layer by coating a solution which includes a solvent, a binder resin and an organic photosensitive material on the electrically conductive substrate, a second step of mechanically wearing the organic photosensitive layer to a degree of 30 Å−2 μm in thickness so as to eliminate an oxidized outermost surface portion of the organic photosensitive layer, and a third step of forming the surface protective layer under vacuum conditions on the organic photosensitive layer.

2. The production method of a photosensitive member of claim 1, in which a charge generating layer is formed on the electrically conductive substrate and then a charge transporting layer is formed on the charge generating layer in the first step.

3. The production method of a photosensitive member of claim 1, in which a charge transporting layer is formed on the electrically conductive substrate and then a charge generating layer is formed on the charge transporting layer in the first step.

4. The production method of a photosensitive member of claim 1, in which:

a charge generating material and a charge transporting material are dispersed in a resin for the formation of the photosensitive layer in the first step.

5. The production method of a photosensitive member of claim 1, in which the surface protective layer comprising amorphous carbon is formed on the organic photosensitive layer by a glow-discharge decomposition method in the third step.

6. The production method of a photosensitive member of claim 1, in which the surface protective layer comprising amorphous silicon is formed on the organic photosensitive layer by a glow-discharge decomposition method in the third step.

7. The production method of a photosensitive member of claim 6, in which the surface protective layer is formed with amorphous silicon carbides.

8. The production method of a photosensitive member of claim 1, in which inorganic oxides are deposited on the photosensitive layer under vacuum conditions for the formation of the surface protective layer.

9. A production method of a photosensitive member having an organic photosensitive layer and a surface protective layer in this order on an electrically conductive substrate comprising:

a first step of forming the organic photosensitive layer by coating a solution which includes a solvent, a binder resin and an organic photosensitive material on the electrically conductive substrate, a second step of dissolving the organic photosensitive layer with a non-chlorinated solvent, in which 30 Å−2 μm in thickness of the surface of the photosensitive layer is removed, so as to eliminate an oxidized outermost surface portion of the organic photosensitive layer; and a third step of forming the surface protective layer under vacuum conditions on the organic photosensitive layer.

10. The production method of a photosensitive member of claim 9, in which the photosensitive layer is dipped in the solvent in the second step.

11. A production method of a photosensitive member having an organic photosensitive layer and a surface protective layer in this order on an electrically conductive substrate comprising:

a first step of forming the organic photosensitive layer by coating a solution which includes a solvent, a binder resin and an organic photosensitive material on the electrically conductive substrate, a second step of leaving the organic photosensitive layer to stand in a vapor phase of a solvent for the time (t) specified by the following formula;

$$Kmin \times H(Tb-Ts) \geqq t \leqq Kmax \times H(Tb-Ts)$$

in which t(sec) is the time standing in the vapor phase, $H[J \cdot K^{-1} \cdot cm^{-2}]$ is the heat capacity per unit area of the surface of the electronically conductive substrate, Tb[K] is the boiling point of the solvent, Ts[K] is the temperature of the electrically conductive substrate measured before the photosensitive layer is exposed to the vapor phase, Kmin is a proportionality factor, being 1 $[J^{-1} \cdot sec]$, and Kmax is a proportionality factor, being 8 $[J^{-1} \cdot cm^2 \cdot sec]$, so as to eliminate an oxidized outermost surface portion of the organic photosensitive layer; and a third step of forming the surface protective layer under vacuum conditions on the organic photosensitive layer.

12. A production method of a photosensitive member having an organic photosensitive layer and a surface protective layer in this order on an electrically conductive substrate comprising:

a first step of forming the organic photosensitive layer by coating a solution which includes a solvent, a binder resin and an organic photosensitive material on the electrically conductive substrate, a second step of bombarding the organic photosensitive layer with ions, in which 30 Å−2 μm in thickness of the surface of the photosensitive layer is removed, so as to eliminate an oxidized outermost surface portion of the organic photosensitive layer; and a third step of forming the surface protective layer under vacuum conditions on the organic photosensitive layer.

13. The production method of a photosensitive member of claim 12, in which the bombardment is carried out in gaseous atmosphere of oxygen-containing molecules.

* * * * *